US009818343B2

(12) United States Patent
Kim et al.

(10) Patent No.: US 9,818,343 B2
(45) Date of Patent: Nov. 14, 2017

(54) ORGANIC LIGHT EMITTING DIODE DISPLAY AND METHOD FOR REPAIRING THE SAME

(71) Applicant: SAMSUNG DISPLAY CO., LTD., Yongin-si, Gyeonggi-Do (KR)

(72) Inventors: Tae Gon Kim, Cheonan-si (KR); Yong Chul Kim, Asan-si (KR); Suk Jin Lee, Asan-si (KR); Eun Mi Jeong, Namyangju-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 9 days.

(21) Appl. No.: 15/040,442

(22) Filed: Feb. 10, 2016

(65) Prior Publication Data

US 2016/0322447 A1 Nov. 3, 2016

(30) Foreign Application Priority Data

Apr. 30, 2015 (KR) ..... 10-2015-0062081
Apr. 30, 2015 (KR) ..... 10-2015-0062086

(51) Int. Cl.
*G09G 3/3233* (2016.01)

(52) U.S. Cl.
CPC ... *G09G 3/3233* (2013.01); *G09G 2300/0842* (2013.01); *G09G 2310/0251* (2013.01); *G09G 2310/0262* (2013.01)

(58) Field of Classification Search
None
See application file for complete search history.

(56) References Cited

U.S. PATENT DOCUMENTS

2008/0150843 A1* 6/2008 Yamamoto ..... G09G 3/3233 345/76
2010/0289025 A1* 11/2010 Nakagawa ..... H01L 27/124 257/59

FOREIGN PATENT DOCUMENTS

| | | |
|---|---|---|
| KR | 1020020030897 | 4/2002 |
| KR | 1020100009808 | 1/2010 |
| KR | 100986845 | 10/2010 |
| KR | 101209809 | 12/2012 |

* cited by examiner

*Primary Examiner* — William Coleman
*Assistant Examiner* — Kien Ly
(74) *Attorney, Agent, or Firm* — F. Chau & Associates, LLC

(57) ABSTRACT

An organic light emitting diode (OLED) display includes a substrate, OLEDs disposed on the substrate and separated from each other, pixel circuits, data lines extending in a first direction on the substrate and separated from each other in a second direction crossing the first direction, connecting lines neighboring the data lines and extending in the first direction, and a wire directly connecting one portion of one of the data lines to one portion of one of the connecting lines neighboring the one data line. Each pixel circuit includes a plurality of thin film transistors and each pixel circuit is connected to one of the OLEDs. The data lines and the connecting lines are connected to the pixel circuits, and one or more surfaces of the one portion of the one data line and the one portion of the one connecting line that contact the wire are curved.

10 Claims, 16 Drawing Sheets

ORGANIC LIGHT EMITTING DIODE DISPLAY AND METHOD FOR REPAIRING THE SAME

CROSS-REFERENCE TO RELATED APPLICATIONS

This application claims priority under 35 U.S.C. §119 to Korean Patent Application No. 10-2015-0062081 and Korean Patent Application No. 10-2015-0062086, both filed in the Korean Intellectual Property Office on Apr. 30, 2015, the entire disclosures of which are incorporated by reference herein in their entireties.

TECHNICAL FIELD

Exemplary embodiments of the present invention relate to an organic light emitting diode (OLED) display and a method for repairing an OLED display.

DISCUSSION OF THE RELATED ART

Flat panel displays include, for example, organic light emitting diode (OLED) displays, liquid crystal displays (LCDs), plasma display panels (PDPs), etc.

An OLED display includes a substrate, a plurality of pixel circuits including a plurality of thin film transistors formed across and disposed on the substrate, and a plurality of OLEDs respectively connected to the plurality of pixel circuits.

SUMMARY

Exemplary embodiments of the present invention provide an organic light emitting diode (OLED) display capable of having one or more faulty pixels efficiently repaired, and a repair method of an OLED display for efficiently repairing one or more of faulty pixels.

According to an exemplary embodiment of the present invention, an organic light emitting diode (OLED) display includes a substrate, a plurality of OLEDs disposed on the substrate and separated from each other, and a plurality of pixel circuits, in which each pixel circuit includes a plurality of thin film transistors and each pixel circuit is connected to one of the plurality of OLEDs. The OLED display further includes a plurality of data lines extending in a first direction on the substrate and separated from each other in a second direction crossing the first direction, in which the plurality of data lines is connected to the plurality of pixel circuits, and a plurality of connecting lines neighboring the data lines and extending in the first direction, in which the plurality of connecting lines is connected to the plurality of pixel circuits. The OLED display further includes a wire directly connecting one portion of one of the plurality of data lines to one portion of one of the plurality of connecting lines neighboring the one data line. One or more surfaces of the one portion of the one data line and the one portion of the one connecting line that contact the wire are curved.

In an exemplary embodiment, the wire includes a first subwire directly connecting a first portion of the one data line to a fourth portion of the one connecting line, and a second subwire separated from the first subwire and directly connecting a second portion of the one data line to a fifth portion of the one connecting line. In an exemplary embodiment, one of the plurality of pixel circuits connected to the one data line is faulty, and the one pixel circuit is cut off from the corresponding OLED.

In an exemplary embodiment, the OLED display further includes a third portion disposed between the first and second portions of the one data line, in which the third portion is cut off and isolated from the first and second portions and is connected to the one pixel circuit. The fourth portion, the fifth portion, and a sixth portion disposed between the fourth and fifth portions of the one connecting line are cut off and isolated from the other portions. The first portion of the one data line is connected to the second portion of the one data line via the first subwire, the fourth, sixth, and fifth portions of the one connecting line, and the second subwire.

In an exemplary embodiment, the plurality of connecting lines is disposed on a same layer as the plurality of data lines.

In an exemplary embodiment, the wire is disposed on the one connecting line and on the one data line.

In an exemplary embodiment, a surface of another portion of the one data line includes a corner.

In an exemplary embodiment, a surface of another portion of the one connecting line includes a corner.

The plurality of thin film transistors may include a first thin film transistor including a first active pattern disposed on the substrate to be connected to the OLED and a first gate electrode disposed on the first active pattern, a second thin film transistor including a second active pattern connected to one end portion of the first active pattern to be connected to the data line and a second gate electrode disposed on the second active pattern, and a third thin film transistor including a third active pattern connected to the other end portion of the first active pattern to be connected to the first gate electrode via the gate bridge and third gate electrode disposed on the third active pattern.

The OLED display may further include a first scan line disposed on the second active pattern crossing each of the second and third active patterns and connected to the second and third gate electrodes, and a driving power line neighboring the data line on the first scan line to cross the first scan line and connected to the first active pattern.

The pixel circuit may be disposed on the first gate electrode and be connected to the driving power line, and may include a capacitor electrode that overlaps the first gate electrode to form a capacitor along with the first gate electrode.

The plurality of thin film transistors may further include a fourth active pattern connected to the third active pattern and connected to the first gate electrode via the gate bridge, and a fourth thin film transistor including a fourth gate electrode disposed on the fourth active pattern. The OLED display may further include a second scan line disposed on the fourth active pattern crossing the fourth active pattern and connected to the fourth gate electrode, and an initialization power supply line connected to the fourth active pattern.

The initialization power supply line may extend in a direction substantially parallel to the other direction and may be connected to the plurality of connecting lines.

The plurality of thin film transistors may further include a fifth thin film transistor including a fifth active pattern connecting the first active pattern and the driving power line to a fifth gate electrode disposed on the fifth active pattern, and a sixth thin film transistor including a sixth active pattern connecting the first active pattern and the OLED to a sixth gate electrode disposed on the sixth active pattern. The plurality of thin film transistors may further include a light emission control line disposed on each of the fifth and sixth active patterns crossing each of the fifth and sixth active patterns and connected to each of the fifth and sixth gate electrodes.

The plurality of thin film transistors may further include a seventh active pattern connected to the fourth active pattern, and a seventh thin film transistor including a seventh gate electrode disposed on the seventh active pattern. The OLED display may further include a third scan line disposed on the seventh active pattern crossing the seventh active pattern and connected to the seventh gate electrode.

According to an exemplary embodiment of the present invention, a method for repairing an OLED display includes curvedly processing one or more surfaces of one portion of one of a plurality of data lines connected to a plurality of pixel circuits, in which the plurality of pixel circuits is disposed on a substrate and includes a plurality of thin film transistors, curvedly processing one portion of one connecting line neighboring the one data line, and connecting the one portion of the one data line to the one portion of the one connecting line using a wire.

In an exemplary embodiment, the one or more surfaces of the one portion of the one data line and the one portion of the one connecting line are curvedly processed using a laser beam.

In an exemplary embodiment, one of the plurality of pixel circuits is faulty.

In an exemplary embodiment, the method further includes curvedly processing each surface of a first portion of the one data line and a second portion of the one data line separated from the first portion, curvedly processing each surface of a fourth portion of the one connecting line and a fifth portion of the one connecting line separated from the fourth portion, directly connecting the first portion of the one data line and the fourth portion of the one connecting line using a first subwire, and directly connecting the second portion of the one data line and the fifth portion of the one connecting line using a second subwire.

In an exemplary embodiment, the method further includes separating and isolating a third portion disposed between the first and second portions of the one data line from the first and second portions, in which the third portion is connected to one of the plurality of pixel circuits, and cutting off and isolating the fourth portion, the fifth portion, and a sixth portion of the one connecting line from the other portions.

According to an exemplary embodiment of the present invention, an OLED display includes a substrate, a plurality of OLEDs disposed on the substrate and separated from each other, a plurality of pixel circuits, in which each pixel circuit includes a plurality of thin film transistors connected to one of the plurality of OLEDs, a plurality of data lines extending in a first direction on the substrate and separated from each other in a second direction crossing the first direction, in which the plurality of data lines is connected to the plurality of pixel circuits, a plurality of connecting lines neighboring the data lines and extending in the first direction, in which the plurality of connecting lines is connected to the plurality of pixel circuits, and a plurality of wires directly connecting portions of the plurality of data lines to portions of the plurality of connecting lines neighboring the respective data lines, in which surfaces of the portions of the plurality of data lines and surfaces of the portions of the plurality of connecting lines are curved.

In an exemplary embodiment, each wire includes a first subwire directly connecting a first portion of one of the data lines and a fourth portion of one of the connecting lines, and a second subwire separated from the first subwire and directly connecting a second portion of the one of the data lines and a fifth portion of the one of the connecting lines.

One of the plurality of pixel circuits connected to the one data line may be faulty, and the one pixel circuit may be cut off from the OLED.

A third portion between the first and second portions of the one data line may be cut off and isolated from the first and second portions while being connected to the one pixel circuit. The fourth portion, the fifth portion, and a sixth portion positioned between the fourth and fifth portions of the one connecting line may be cut off and isolated from the other portions, and the first portion of the one data line may be connected to the second portion of the one data line via the first subwire, the fourth, sixth, and fifth portions of the one connecting line, and the second subwire.

The plurality of connecting lines may be disposed on the same layer as the plurality of data lines.

The wire may be disposed on the one data line and on the one connecting line.

A surface of the other portion of each of the plurality of data lines may include a corner.

A surface of the other portion of each of the plurality of connecting lines may include a corner.

The plurality of thin film transistors may include a first thin film transistor including a first active pattern disposed on the substrate and connected to the OLED and a first gate electrode disposed on the first active pattern, a second thin film transistor including a second active pattern connected to one end portion of the first active pattern to be connected to the data line and a second gate electrode disposed on the second active pattern, and a third thin film transistor including a third active pattern connected to the other end portion of the first active pattern to be connected to the first gate electrode via the gate bridge and third gate electrode disposed on the third active pattern.

The OLED display may further include a first scan line disposed on the second active pattern, crossing each of the second and third active patterns, and connected to the second and third gate electrodes, and a driving power line neighboring the data line on the first scan line to cross the first scan line and connected to the first active pattern.

The pixel circuit may be disposed on the first gate electrode and be connected to the driving power line, and may include a capacitor electrode that overlaps the first gate electrode to form a capacitor along with the first gate electrode.

The plurality of thin film transistors may further include a fourth active pattern connected to the third active pattern and connected to the first gate electrode via the gate bridge, and a fourth thin film transistor including a fourth gate electrode disposed on the fourth active pattern. The OLED display may further include a second scan line disposed on the fourth active pattern crossing the fourth active pattern and connected to the fourth gate electrode, and an initialization power supply line connected to the fourth active pattern.

The initialization power supply line may extend in a direction substantially parallel to the other direction and may be connected to the plurality of connecting lines. The plurality of thin film transistors may further include a fifth thin film transistor including a fifth active pattern connecting the first active pattern and the driving power line to a fifth gate electrode disposed on the fifth active pattern, and a sixth thin film transistor including a sixth active pattern connecting the first active pattern and the OLED to a sixth gate electrode disposed on the sixth active pattern. The OLED display may further include a light emission control line disposed on each of the fifth and sixth active patterns crossing each of the fifth and sixth active patterns and connected to each of the fifth and sixth gate electrodes and the sixth gate electrode.

The plurality of thin film transistors may further include a seventh active pattern connected to the fourth active pattern, and a seventh thin film transistor including a seventh gate electrode disposed on the seventh active pattern. The OLED display may further include a third scan line disposed on the seventh active pattern crossing the seventh active pattern and connected to the seventh gate electrode.

According to an exemplary embodiment of the present invention, a method for repairing an OLED display includes forming a plurality of data lines, in which one portion of each data line is connected to one of a plurality of pixel circuits including a plurality of thin film transistors disposed on a substrate, and in which the one portion of each data line includes a curved surface, forming a plurality of connecting lines, in which one portion of each connecting line is connected to one of the plurality of pixel circuits, and in which the one portion of each connecting line comprises a curved surface, and connecting the one portion of one of the plurality of data lines to the one portion of one of the plurality of connecting lines using a wire.

In an exemplary embodiment, forming the plurality of data lines and the plurality of connecting lines is performed using a halftone mask.

In an exemplary embodiment, one of the plurality of pixel circuits is faulty.

In an exemplary embodiment, surfaces of a first portion and a second portion of each of the plurality of data lines are formed to be separated from each other and are curved, and surfaces of a fourth portion and a fifth portion of each of the plurality of connecting lines are formed to be separated from each other and are curved. The repair method further includes directly connecting the first portion to the fourth portion using a first subwire of the wire, and directly connecting the second portion to the fifth portion a second subwire of the wire.

In an exemplary embodiment, the method further includes separating and isolating a third portion disposed between the first and second portions from the first and second portions, in which the third portion is connected to the one pixel circuit, and cutting off and isolating the fourth portion, the fifth portion, and a sixth portion of the one connecting line from the other portions.

According to an exemplary embodiment of the present invention, an OLED display includes a substrate, a plurality of OLEDs disposed on the substrate and separated from each other, a plurality of pixel circuits, in which each pixel circuit includes a plurality of thin film transistors and each pixel circuit is connected to one of the plurality of OLEDs, a plurality of data lines extending in a first direction on the substrate and separated from each other in a second direction crossing the first direction, in which the plurality of data lines is connected to the plurality of pixel circuits, a plurality of connecting lines neighboring the data lines and extending in the first direction, in which the plurality of connecting lines is connected to the plurality of pixel circuits, and a wire connecting a curved portion of one of the plurality of data lines to a curved portion of a neighboring one of the plurality of connecting lines.

In an exemplary embodiment, each of the curved portion of the one data line and the curved portion of the neighboring one connecting line has a circular shape and does not include a corner.

According to exemplary embodiments of the present invention, an OLED display in which one or more faulty pixels may be repaired, as well as methods for efficiently repairing one or more faulty pixels, are provided.

BRIEF DESCRIPTION OF THE DRAWINGS

The above and other features of the present invention will become more apparent by describing in detail exemplary embodiments thereof with reference to the accompanying drawings, in which.

DETAILED DESCRIPTION OF THE EXEMPLARY EMBODIMENTS

Figure 1:
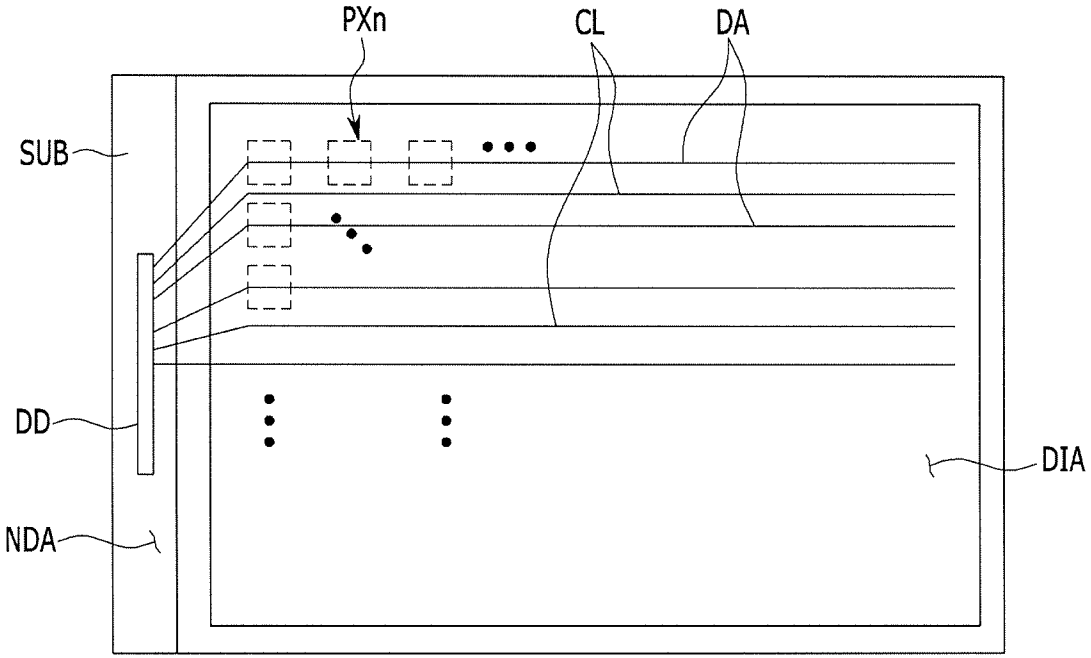
FIG. 1 is a schematic plan view of an organic light emitting diode (OLED) display according to an exemplary embodiment of the present invention.

Exemplary embodiments of the present invention will be described more fully hereinafter with reference to the accompanying drawings. In the drawings, the size and relative sizes of layers and regions may be exaggerated for clarity. Like reference numerals may refer to like elements throughout the accompanying drawings.

In the drawings, the thickness of layers, films, panels, regions, etc. may be exaggerated for clarity.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. In addition, it will also be understood that when a layer is referred to as being "between" two layers, it can be the only layer between the two layers, or one or more intervening layers may also be present.

It will further be understood that when a component, such as a film, a region, a layer, or an element, is referred to as being "on", "connected to", "coupled to", or "adjacent to" another component, it can be directly on, connected, coupled, or adjacent to the other component, or intervening components may be present. It will also be understood that when a component is referred to as being "between" two components, it can be the only component between the two components, or one or more intervening components may also be present. It will further be understood that although the terms "first" and "second" may be used herein to describe various components, these components should not be limited by these terms.

Referring to FIGS. 1 to 5, an organic light emitting diode (OLED) display according to an exemplary embodiment of the present invention will be described.

FIG. 1 is a schematic plan view of an OLED display according to an exemplary embodiment of the present invention. Herein, each pixel may represent a minimum unit for displaying an image.

As shown in FIG. 1, the OLED display according to an exemplary embodiment includes a substrate SUB, a plurality of pixels PXn, a plurality of data lines DA, a plurality of connecting lines CL, and a data driver DD.

The substrate SUB includes a display area DIA that displays an image and a non-display area NDA neighboring the display area DIA. The non-display area NDA may be disposed to surround edges of the display area DIA. However, exemplary embodiments are not limited thereto. For example, according to exemplary embodiments, the non-display area NDA may be disposed in various regions on the substrate SUB, and the non-display area NDA may partially or entirely surround edges of the display area DIA. The substrate SUB is an insulating substrate that includes, for example, glass, a polymer, or stainless steel. The substrate SUB may be, for example, flexible, stretchable, foldable, bendable, or rollable. The substrate SUB being flexible, stretchable, foldable, bendable, or rollable allows the entire OLED display to be flexible, stretchable, foldable, bendable, or rollable.

The plurality of pixels PXn are disposed in the display area DIA of the substrate SUB on the substrate SUB. Each of the plurality of pixels PXn is connected to a data line DA and a connecting line CL. Each of the plurality of pixels PXn includes an OLED for emitting light with luminance corresponding to a driving current associated with a data signal provided from each of the data lines DA, and a pixel circuit including a plurality of thin film transistors that control the driving current flowing through the OLED and one or more capacitors. The OLED in each of the plurality of pixels PXn is connected to a pixel circuit.

The plurality of pixels PXn may be connected to a plurality of scan lines connected to a gate driver for providing different scan signals, and may be further connected to a driving power line for providing a voltage and an initialization power supply line connected to a connecting line CL. In addition, a second electrode may be connected as a cathode of the OLED included in each of the plurality of pixels PXn to a common power supply. A specific structure of each of the plurality of pixels PXn will be described below. The gate driver, the plurality of scan lines, the driving power line, and the initialization power supply line described above will be further described below. However, it is to be understood that these components are not limited to the following description. For example, according to exemplary embodiments, various wires may be connected in various known forms to each of the plurality of pixels PXn.

In an exemplary embodiment, the data driver DD is disposed on the non-display area NDA of the substrate SUB, and is connected to the plurality of data lines DA and the plurality of connecting lines CL. In an exemplary embodiment, each of the plurality of data lines DA and each of the plurality of connecting lines CL is not connected to the data driver DD, and is instead connected to other driving units.

The plurality of data lines DA respectively extend in one direction to be arranged on the substrate SUB while being separated from each other in the other direction crossing the one direction, and are connected to the respective pixel circuits of the plurality of pixels PXn.

The plurality of connecting lines CL respectively extend in a direction substantially parallel to the one direction while neighboring the data lines DA, and are connected to the respective pixel circuits of the plurality of pixels PXn.

Figure 2:
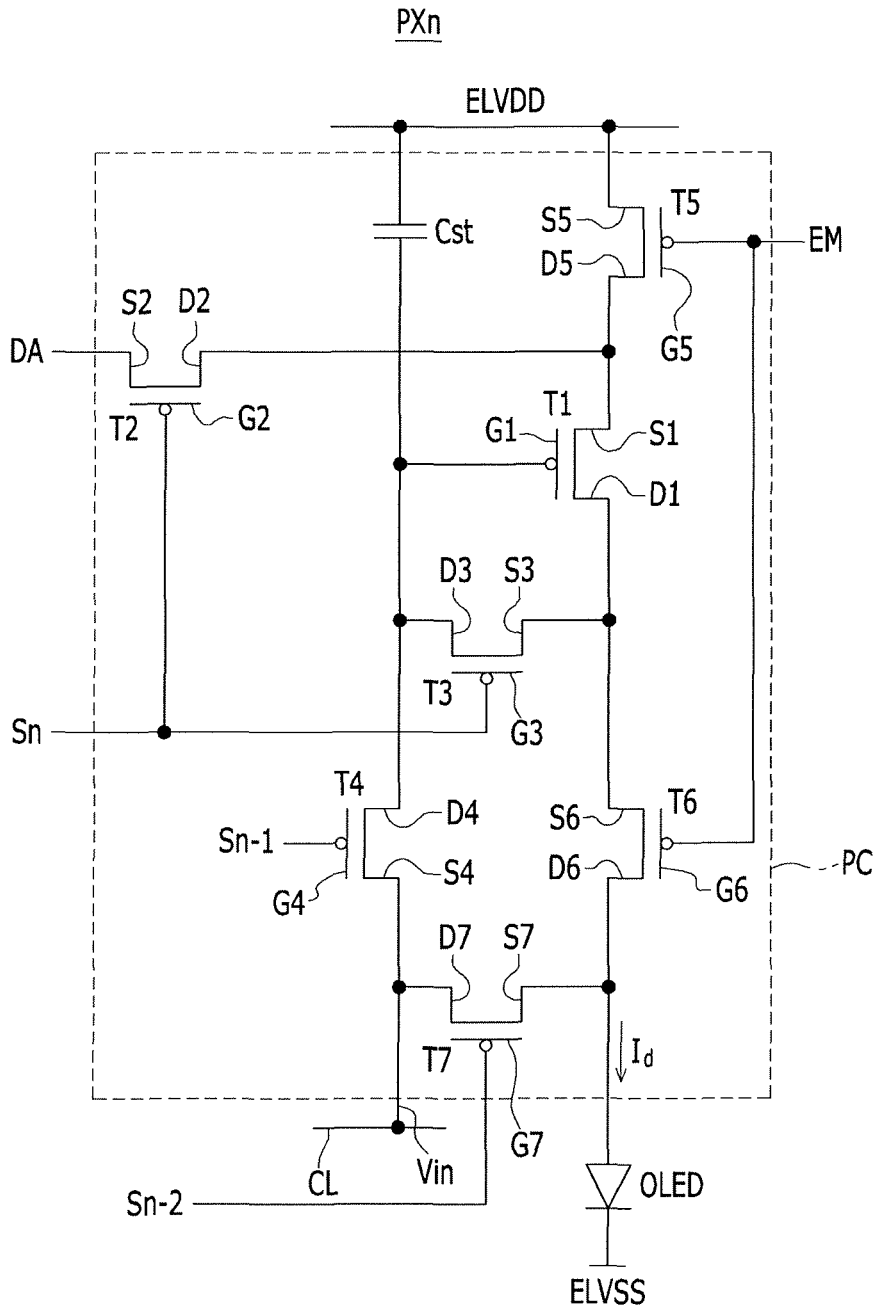
FIG. 2 is a circuit diagram of one pixel of the OLED display according to the exemplary embodiment illustrated in FIG. 1.

Referring to FIG. 2, a circuit of one pixel PXn of the OLED display according to an exemplary embodiment will be described.

FIG. 2 is a circuit diagram of one pixel of the OLED display according to the exemplary embodiment illustrated in FIG. 1.

As shown in FIG. 2, one pixel PXn of the OLED display includes a pixel circuit PC including a plurality of thin film transistors T1, T2, T3, T4, T5, T6, and T7, a capacitor Cst, a plurality of wires Sn, Sn-1, Sn-2, EM, Vin, CL, DA, and ELVDD, which are selectively connected to the plurality of thin film transistors T1, T2, T3, T4, T5, T6, and T7, and an OLED.

The plurality of thin film transistors T1, T2, T3, T4, T5, T6, and T7 includes a first thin film transistor T1, a second thin film transistor T2, a third thin film transistor T3, a fourth thin film transistor T4, a fifth thin film transistor T5, a sixth thin film transistor T6, and a seventh thin film transistor T7.

A first gate electrode G1 of the first thin film transistor T1 is connected to each of a third drain electrode D3 of the third thin film transistor T3 and a fourth drain electrode D4 of the fourth thin film transistor T4, a first source electrode S1 of the first thin film transistor T1 is connected to a second drain electrode D2 of the second thin film transistor T2 and a fifth drain electrode D5 of the fifth thin film transistor T5, and a first drain electrode D1 of the first thin film transistor T1 is connected to each of a third source electrode S3 of the third thin film transistor T3 and a sixth source electrode S6 of the sixth thin film transistor T6.

A second gate electrode G2 of the second thin film transistor T2 is connected to a first scan line Sn, and a second source electrode S2 thereof is connected to a data line DA.

The second drain electrode D2 is connected to the first source electrode S1 of the first thin film transistor T1.

A third gate electrode G3 of the third thin film transistor T3 is connected to the first scan line Sn, the third source electrode S3 of the third thin film transistor T3 is connected to the first drain electrode D1 of the first thin film transistor T1, and the third drain electrode D3 of the third thin film transistor T3 is connected to the first gate electrode G1 of the first thin film transistor T1.

A fourth gate electrode G4 of the fourth thin film transistor T4 is connected to a second scan line Sn-1, a fourth source electrode S4 of the fourth thin film transistor T4 is connected to an initialization power supply line Vin connected to a connecting line CL, and the fourth drain electrode D4 of the fourth thin film transistor T4 is connected to the first gate electrode G1 of the first thin film transistor T1.

A fifth gate electrode G5 of the fifth thin film transistor T5 is connected to a light emission control line EM, a fifth source electrode S5 of the fifth thin film transistor T5 is connected to a driving power supply line ELVDD, and the fifth drain electrode D5 of the fifth thin film transistor is connected to the first source electrode S1 of the first thin film transistor T1.

A sixth gate electrode G6 of the sixth thin film transistor T6 is connected to the light emission control line EM, and the sixth source electrode S6 of the sixth thin film transistor T6 is connected to the first drain electrode D1 of the first thin film transistor T1.

A seventh gate electrode G7 of the seventh thin film transistor T7 is connected to a third scan line Sn-2, a seventh source electrode S7 of the seventh thin film transistor T7 is connected to the OLED, and a seventh drain electrode D7 of the seventh thin film transistor T7 is connected to the fourth source electrode S4 of the fourth thin film transistor T4.

In an exemplary embodiment, the plurality of scan lines described above includes the first scan line Sn that transmits a first scan signal to each of the second and third gate electrodes G2 and G3 of the second and third thin film transistors T2 and T3, the second scan line Sn-1 that transmits a second scan signal to the fourth gate electrode G4 of the fourth thin film transistor T4, the third scan line Sn-2 that transmits a third scan signal to the seventh gate electrode G7 of the seventh thin film transistor T7, and the light emission control line EM that transmits a light emission control signal to each of the fifth and sixth gate electrodes G5 and G6 of the fifth and sixth thin film transistors T5 and T6.

The capacitor Cst includes, for example, one electrode connected to the driving power supply line ELVDD, and the other electrode connected to the first gate electrode GI and the third drain electrode D3 of the third thin film transistor T3.

The OLED includes, for example, a first electrode, a second electrode disposed on the first electrode, and an organic emission layer disposed between the first and second electrodes. The first electrode of the OLED is connected to each of the seventh source electrode S7 of the seventh thin film transistor T7 and the sixth drain electrode D6 of the sixth thin film transistor T6, and the second electrode of the OLED is connected to a common power supply ELVSS via which a common signal is transmitted.

As an example, an operation of one pixel PXn including the pixel circuit PC, the plurality of wires Sn, Sn-1, Sn-2, EM, Vin, CL, DA, and ELVDD, and the OLED will be described further herein. When the third scan signal is transmitted and the seventh thin film transistor T7 is turned on, a residual current flowing through the first electrode of the OLED flows to the fourth thin film transistor T4 via the seventh thin film transistor T7, which may suppress undesired light emission of the OLED by the residual current flowing through the first electrode of the OLED.

When the second scan signal is transmitted to the second scan line Sn-1 and an initialization signal is transmitted to the initialization power supply line Vin via the connecting line CL, the fourth thin film transistor T4 is turned on, and an initialization voltage associated with the initialization signal is provided to the first gate electrode G1 of the first thin film transistor T1 and the other electrode of the capacitor Cst via the fourth thin film transistor T4, thereby initializing the first gate electrode G1 and the capacitor Cst. In this case, as the first gate electrode G1 is initialized, the first thin film transistor T1 is turned on.

When the first scan signal is transmitted to the first scan line Sn and a data signal is transmitted to the data line DA, each of the second and third thin film transistors T2 and T3 is turned on, and a data voltage Vd associated with the data signal is provided to the first gate electrode G1 via the second thin film transistor T2, the first thin film transistor T1, and the third thin film transistor T3. In this case, a compensation voltage Vd+Vth (in which Vth is a negative value), which is a voltage reduced by a threshold voltage (Vth) of the first thin film transistor T1 from the data voltage Vd initially provided via the data line DA, is provided to the first gate electrode G1. The compensation voltage Vd+Vth provided to the first gate electrode G1 is also provided to the other electrode of the capacitor Cst that is connected to the first gate electrode G1.

By providing a driving voltage Vel associated with a driving signal from the driving power supply line ELVDD to one electrode of the capacitor Cst while providing the compensation voltage Vd+Vth to the other electrode thereof, an amount of charge corresponding to a difference in voltage applied to each of the opposing electrodes of the capacitor Cst is stored therein, thereby turning the first thin film transistor T1 on for a predetermined amount of time.

When the light emission control signal is applied to the light emission control line EM, each of the fifth and sixth thin film transistors T5 and T6 is turned on, and the driving voltage Vel associated with the driving signal from the driving power supply line ELVDD is provided to the first thin film transistor T1 via the fifth thin film transistor T5.

As the driving voltage Vel is being transmitted via the first thin film transistor T1 that is turned on by the capacitor Cst, a driving current Id corresponding to a difference between the voltage provided to the first gate electrode G1 by the capacitor Cst and the driving voltage Vel flows through the first drain electrode D1 of the first thin film transistor T1, and the driving current Id is supplied to the OLED via the sixth thin film transistor T6, thereby allowing the OLED to emit light for a predetermined amount of time.

The OLED display according to an exemplary embodiment includes the pixel circuit PC including the first to seventh thin film transistors T1 to T7 and the capacitor Cst, and the first to third scan lines Sn to Sn-2, the data line DA, the driving power supply line ELVDD, the initialization power supply line Vin, and the connecting line CL that are connected to the pixel circuit PC. However, exemplary embodiments are not limited thereto. For example, according to an exemplary embodiment, an OLED display may include a pixel circuit including a plurality of thin film transistors and one or more capacitors, and wires including one or more scan lines and one or more driving power lines that are connected to the pixel circuit.

Figure 3:
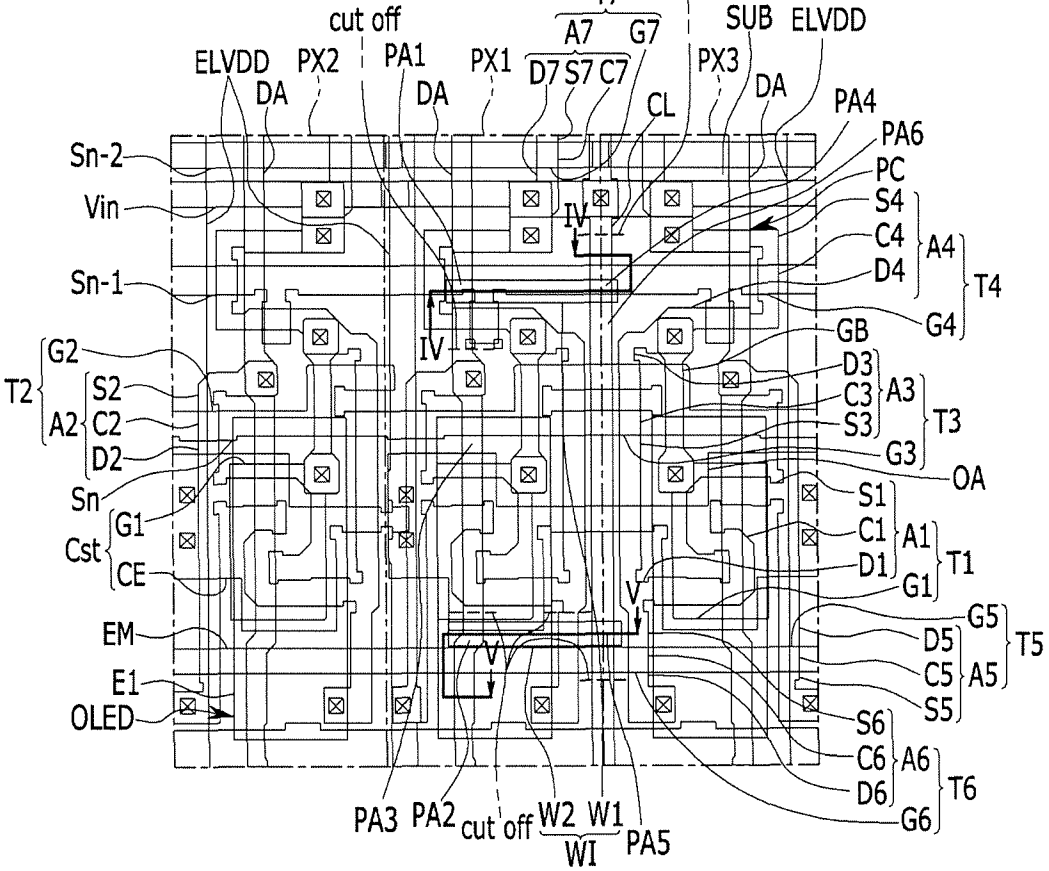
FIG. 3 is a layout view of first, second, and third pixels of a plurality of pixels of the OLED display according to the exemplary embodiment illustrated in FIG. 1.

Referring to FIG. 3, the arrangement of the first, second, and third pixels PX1, PX2, and PX3 of the plurality of pixels PXn of the aforementioned OLED display according to an exemplary embodiment, which are disposed in the display area DIA of the substrate SUB and neighbor each other, will be described.

FIG. 3 is a layout view of the first, second, and third pixels of the plurality of pixels of the OLED display according to the exemplary embodiment illustrated in FIG. 1.

As shown in FIG. 3, each of the first, second, and third pixels PX1, PX2, and PX3 disposed on the substrate SUB to neighbor each other includes the first thin film transistor T1, the second thin film transistor T2, the third thin film transistor T3, the fourth thin film transistor T4, the fifth thin film transistor T5, the sixth thin film transistor T6, the seventh thin film transistor T7, the first scan line Sn, the second scan line Sn-1, the third scan line Sn-2, the light emission control line EM, the capacitor Cst, the data line DA, the driving power supply line ELVDD, a gate bridge GB, the connecting line CL, the initialization power supply line Vin, and the OLED. Here, the first pixel PX1 is different from the second and third pixels PX2 and PX3 in that it further includes a wire WI.

In an exemplary embodiment, the first, second, third, fourth, fifth, sixth, and seventh thin film transistors T1, T2, T3, T4, T5, T6, and T7, which are the plurality of thin film transistors of the first, second, and third pixels PX1, PX2, and PX3, the gate bridge GB, and the capacitor Cst, form the pixel circuit PC.

The first thin film transistor T1 is disposed on the substrate SUB, and includes a first active layer A1 and the first gate electrode G1.

The first active layer A1 includes the first source electrode S1, a first channel C1, and the first drain electrode D1. The first source electrode S1 is connected to each of the second drain electrode D2 of the second thin film transistor T2 and the fifth drain electrode D5 of the fifth thin film transistor T5, and the first drain electrode D1 of the first active layer A1 is connected to each of the third source electrode S3 of the third thin film transistor T3 and the sixth source electrode S6 of the sixth thin film transistor T6. The first channel C1, which is a channel region of the first active layer A1 overlapping the first gate electrode G1, is bent at least once to extend, and a wide driving range of the gate voltage may be applied to the first gate electrode G1, since the first channel C1 is bent at least once to extend within a limited space overlapping the first gate electrode G1 such that a length of the first channel C1 is extended. Accordingly, the gate voltage applied to the first gate electrode G1 may be varied within the wide driving range to more precisely control a gray level of light emitted from the OLED, which may improve the quality of images displayed on the OLED display. The first active layer A1 may be modified to have various shapes. For example, according to exemplary embodiments, the first active layer A1 may be modified to have various shapes such as a 'reverse S', 'S', 'M', 'W', etc.

The first active layer A1 may be formed of, for example, polysilicon or an oxide semiconductor. The oxide semiconductor may include one of the oxides based on, for example, titanium (Ti), hafnium (Hf), zirconium (Zr), aluminum (A1), tantalum (Ta), germanium (Ge), zinc (Zn), gallium (Ga), tin (Sn), or indium (In), and complex oxides thereof such as, for example, zinc oxide (ZnO), indium-gallium-zinc oxide (In-$GaZnO_4$), indium-zinc oxide (Zn—In—O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—A1—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O). In an exemplary embodiment, when the first active layer A1 is formed of an oxide semiconductor, a separate passivation layer may be added to protect the oxide semiconductor, which may otherwise be vulnerable to elements from an external environment such as, for example, high temperature and the like.

The first channel C1 of the first active layer A1 may be channel-doped with an N or P-type impurity. The first source electrode S1 and the first drain electrode D1 are separated from each other while interposing the first channel C1 therebetween to be doped with an opposite type of doping impurity to a doping impurity doped in the first channel C1.

The first gate electrode G1 is disposed on the first channel C1 of the first active layer A1, and is in the shape of an island. The first gate electrode G1 is connected to the fourth drain electrode D4 of the fourth thin film transistor T4 and the third drain electrode D3 of the third thin film transistor T3 by a gate bridge GB through which the contact hole CNT is connected. The first gate electrode G1 overlaps a capacitor electrode CE, and may serve as both the gate electrode of the first thin film transistor T1 and the other electrode of the capacitor Cst. That is, the first gate electrode G1 forms the capacitor Cst along with the capacitor electrode CE.

The second thin film transistor T2 is disposed on the substrate SUB, and includes a second active layer A2 and the second gate electrode G2. The second active layer A2 includes the second source electrode S2, a second channel C2, and the second drain electrode D2. The second source electrode S2 is connected to the data line DA via the contact hole, and the second drain electrode D2 is connected to the first source electrode S1 of the first thin film transistor T1. The second channel C2, which is a channel region of the second active layer A2 overlapping the second gate electrode G2, is disposed between the second source electrode S2 and the second drain electrode D2. That is, the second active layer A2 is connected to the first active layer A1.

The second channel C2 of the second active layer A2 may be channel-doped with an N or P-type impurity. The second source electrode S2 and the second drain electrode D2 may be separated from each other while interposing the first channel C1 therebetween to be doped with an opposite type of doping impurity to a doping impurity doped in the first channel C1. The second active layer A2 is disposed on the same layer, formed of the same material, and integrally formed with the first active layer A1.

The second gate electrode G2 is disposed on the second channel C2 of the second active layer A2, and is integrally formed with the first scan line Sn.

The third thin film transistor T3 is disposed on the substrate SUB, and includes a third active layer A3 and the third gate electrode G3.

The third active layer A3 includes the third source electrode S3, a third channel C3, and the third drain electrode D3. The third source electrode S3 is connected to the first drain electrode D1, and the third drain electrode D3 is connected to the first gate electrode G1 of the first thin film transistor T1 via the gate bridge GB through which the contact hole is reached. The third channel C3, which is a channel region of the third active layer A3 overlapping the third gate electrode G3, is disposed between the third source electrode S3 and the third drain electrode D3. That is, the third active layer A3 connects the first active layer A1 to the first gate electrode G1.

The third channel C3 of the third active layer A3 may be channel-doped with an N or P-type impurity. The third source electrode S3 and the third drain electrode D3 are separated from each other while interposing the third channel C3 therebetween to be doped with an opposite type of doping impurity to a doping impurity doped in the third channel C3. The third active layer A3 is formed on the same layer, formed of the same material, and integrally formed with the first and second active layers A1 and A2.

The third gate electrode G3 is disposed on the third channel C3 of the third active layer A3, and is integrally formed with the first scan line Sn. The third gate electrode G3 is formed as a dual gate electrode.

The fourth thin film transistor T4 is disposed on the substrate SUB, and includes a fourth active layer A4 and the fourth gate electrode G4.

The fourth active layer A4 includes the fourth source electrode S4, a fourth channel C4, and the fourth drain electrode D4. The fourth source electrode S4 is connected to the initialization power supply line Vin that is connected to the connecting line CL via the contact hole. The fourth drain electrode D4 is connected to the first gate electrode G1 of the first thin film transistor T1 via the gate bridge GB through which the contact hole is reached. The fourth channel C4, which is a channel region of the fourth active layer A4 overlapping the fourth gate electrode G4, is disposed between the fourth source electrode S4 and the fourth drain electrode D4. That is, the fourth active layer A4 connects the initialization power supply line Vin to the first gate electrode G1 while being connected to each of the third active layer A3 and the first gate electrode G1.

The fourth channel C4 of the fourth active layer A4 may be channel-doped with an N or P-type impurity. The fourth source electrode S4 and the fourth drain electrode D4 may be separated from each other while interposing the fourth channel C4 therebetween to be doped with an opposite type of doping impurity to a doping impurity doped in the fourth channel C4. The fourth active layer A4 is disposed on the same layer, formed of the same material, and integrally formed with the first, second, and third active layers A1, A2, and A3.

The fourth gate electrode G4 is disposed on the fourth channel C4 of the fourth active layer A4, and is integrally formed with the second scan line Sn-1. The fourth gate electrode G4 is formed as a dual gate electrode.

The fifth thin film transistor T5 is disposed on the substrate SUB, and includes a fifth active layer A5 and the fifth gate electrode G5.

The fifth active layer A5 includes the fifth source electrode S5, a fifth channel C5, and the fifth drain electrode D5. The fifth source electrode S5 is connected to the driving power supply line ELVDD via the contact hole, and the fifth drain electrode D5 is connected to the first source electrode S1 of the first thin film transistor T1. The fifth channel C5, which is a channel region of the fifth active layer A5 overlapping the fifth gate electrode G5, is disposed between the fifth source electrode S5 and the fifth drain electrode D5. That is, the fifth active layer A5 connects the driving power supply line ELVDD to the first active layer A1.

The fifth channel C5 of the fifth active layer A5 may be channel-doped with an N or P-type impurity. The fifth source electrode S5 and the fifth drain electrode D5 are separated from each other while interposing the fifth channel C5 to be doped with an opposite type of doping impurity to a doping impurity doped in the fifth channel C5. The fifth active layer A5 is disposed on the same layer, formed of the same material, and integrally formed with the first, second, third, and fourth active layers A1, A2, A3, and A4.

The fifth gate electrode G5 is disposed on the fifth channel C5 of the fifth active layer A5, and is integrally formed with the light emission control line EM.

The sixth thin film transistor T6 is disposed on the substrate SUB, and includes a sixth active layer A6 and the sixth gate electrode G6.

The sixth active layer A6 includes the sixth source electrode S6, a sixth channel C6, and the sixth drain electrode D6. The sixth source electrode S6 is connected to the first drain electrode D1 of the first thin film transistor T1, and the sixth drain electrode D6 is connected to the first electrode E1 of the OLED via the contact hole. The sixth channel C6, which is a channel region of the sixth active layer A6 overlapping the sixth gate electrode G6, is disposed between the sixth source electrode S6 and the sixth drain electrode D6. That is, the sixth active layer A6 connects the first active layer A1 to the first electrode E1 of the OLED.

The sixth channel C6 of the sixth active layer A6 may be channel-doped with an N or P-type impurity. The sixth source electrode S6 and the sixth drain electrode D6 are separated from each other while interposing the sixth channel C6 therebetween to be doped with an opposite type of doping impurity to a doping impurity doped in the sixth channel C6. The sixth active layer A6 is formed on the same layer, formed of the same material, and integrally formed with the first, second, third, fourth, and fifth active layers A1, A2, A3, A4, and A5.

The sixth gate electrode G6 is disposed on the sixth channel C6 of the sixth active layer A6, and is integrally formed with the light emission control line EM.

The seventh thin film transistor T7 is disposed on the substrate SUB, and includes a seventh active layer A7 and the seventh gate electrode G7.

The seventh active layer A7 includes the seventh source electrode S7, a seventh channel C7, and the seventh drain electrode D7. The seventh source electrode S7 is connected to a first electrode of an OLED of another pixel not illustrated in FIG. 3 (e.g., a pixel disposed above the pixel illustrated in FIG. 3), and the seventh drain electrode D7 is connected to the fourth source electrode S4 of the fourth thin film transistor T4. The seventh channel C7, which is a channel region of the seventh active layer A7 overlapping the seventh gate electrode G7, is disposed between the seventh source electrode S7 and the seventh drain electrode D7. That is, the seventh active layer A7 connects the first electrode of the OLED to the fourth active layer A4.

The seventh channel C7 of the seventh active layer A7 may be channel-doped with an N or P-type impurity. The seventh source electrode S7 and the seventh drain electrode D7 are separated from each other while interposing the seventh channel C7 therebetween to be doped with an opposite type of doping impurity to a doping impurity doped in the seventh channel C7. The seventh active layer A7 is disposed on the same layer, formed of the same material, and integrally formed with the first, second, third, fourth, fifth and sixth active layers A1, A2, A3, A4, A5, and A6.

The seventh gate electrode G7 is disposed on the seventh channel C7 of the seventh active layer A7, and is integrally formed with the third scan line Sn-2.

The first scan line Sn is disposed on the second and third active layers A2 and A3 to extend in a direction crossing the second and third active layers A2 and A3, and is integrally formed with and connected to the second and third gate electrodes G2 and G3.

The second scan line Sn-1 is disposed on the fourth active layer A4 while being separated from the first scan line Sn, extends in a direction crossing the fourth active layer A4, and is integrally formed with and connected to the fourth gate electrode G4.

The third scan line Sn-2 is disposed on the seventh active layer A7 while being separated from the second scan line Sn-1, extends in a direction crossing the seventh active layer A7, and is integrally formed with and connected to the seventh gate electrode G7.

The light emission control line EM is disposed on the fifth and sixth active layers A5 and A6 while being separated from the first scan line Sn, extends in a direction crossing the fifth and sixth active layers A5 and A6, and is integrally formed with and connected to the fifth and sixth gate electrodes G5 and G6.

In an exemplary embodiment, the light emission control line EM, the third scan line Sn-2, the second scan line Sn-1, the first scan line Sn, the first gate electrode G1, the second gate electrode G2, the third gate electrode G3, the fourth gate electrode G4, the fifth gate electrode G5, the sixth gate electrode G6, and the seventh gate electrode G7, which are described above, are disposed on the same layer and are formed of the same material. In an exemplary embodiment, the light emission control line EM, the third scan line Sn-2, the second scan line Sn-1, the first scan line Sn, the first gate electrode G1, the second gate electrode G2, the third gate electrode G3, the fourth gate electrode G4, the fifth gate electrode G5, the sixth gate electrode G6, and the seventh gate electrode G7 may respectively be selectively disposed on different layers and may be formed of different materials.

The capacitor Cst includes one electrode and another electrode that face each other while interposing an insulating layer therebetween. The one electrode described above may be, for example, the capacitor electrode CE, and the other electrode may be the first gate electrode G1. The capacitor electrode CE is disposed on the first gate electrode G1, and is connected to the driving power supply line ELVDD via the contact hole.

The capacitor electrode CE forms the capacitor Cst along with the first gate electrode G1. The first gate electrode G1 and the capacitor electrode CE are respectively formed of different metals or the same metal on different layers.

The capacitor electrode CE includes an opening OA through which part of the first gate electrode G1 is exposed. The gate bridge GB is connected to the first gate electrode G1 via the opening OA.

The data line DA is disposed above the first scan line Sn and extends in one direction crossing the first scan line Sn, and the plurality of data lines DA are disposed in the other direction crossing the one direction while being separated from each other. The data line DA is connected to the second source electrode S2 of the second active layer A2 via the contact hole. The data line DA extends to cross the first scan line Sn, the second scan line Sn-1, the third scan line Sn-2, the light emission control line EM, and the initialization power supply line Vin.

The driving power supply line ELVDD is disposed on the first scan line Sn and extends in one direction crossing the first scan line Sn while being separated from the data line DA, and is connected to the fifth source electrode S5 of the fifth active layer A5 that is connected to the capacitor electrode CE and the first active layer A1 via the contact hole. The driving power supply line ELVDD extends to cross the first scan line Sn, the second scan line Sn-1, the third scan line Sn-2, the light emission control line EM, and the initialization power supply line Vin.

The gate bridge GB is separated from the driving power supply line ELVDD and is connected to each of the third drain electrode D3 of the third active layer A3 and the fourth drain electrode D4 of the fourth active layer A4 via the contact hole. The gate bridge GB is further connected to the first gate electrode G1 that is exposed by the opening OA of the capacitor electrode CE via the contact hole. That is, the gate bridge GB connects the first thin film transistor T1 to the third thin film transistor T3 and the fourth thin film transistor T4.

The connecting line CL is disposed between the neighboring data lines DA, and extends in a direction substantially parallel to the one direction which is an extending direction of the data line DA. The connecting line CL is connected to the initialization power supply line Vin, and is connected to each of the first, second, and third pixels PX1, PX2, and PX3 via the initialization power supply line Vin. Since the connecting line CL extends in the direction substantially parallel to the one direction and the initialization power supply line Vin extends in the direction crossing the connecting line CL, the connecting line CL and the initialization power supply line Vin are arranged in a planar matrix form across the entire substrate SUB.

In an exemplary embodiment, the connecting line CL is disposed on the same layer as the gate bridge GB, the data line DA, and the driving power supply line ELVDD and is formed of the same material. In an exemplary embodiment, the connecting line CL, the data line DA, the driving power supply line ELVDD, and the gate bridge GB may respectively be selectively disposed on different layers and may be formed of different materials.

The initialization power supply line Vin extends in a direction crossing the extending direction of the connecting line CL, and extends in a direction substantially parallel to the other direction described above in which the plurality of data lines DA are arranged. The initialization power supply line Vin is connected to the connecting line CL via the contact hole and is also connected to the fourth source electrode S4 of the fourth active layer A4 via the contact hole. In an exemplary embodiment, the initialization power supply line Vin is disposed on the same layer as the capacitor electrode CE and is formed of the same material as the capacitor electrode CE. In an exemplary embodiment, the initialization power supply line Vin may be disposed on a different layer than the capacitor electrode CE and may be formed of a different material.

The OLED includes the first electrode E1, the organic emission layer, and the second electrode. The first electrode E1 is connected to the sixth drain electrode D6 of the sixth thin film transistor T6 via the contact hole. The first electrode E1, the organic emission layer, and the second electrode may be sequentially laminated. One or more of the first electrode E1 and the second electrode may be at least any one of, for example, a light transmissive electrode, a light reflective electrode, and a light transflective electrode. Light radiated from the organic emission layer may be emitted toward one or more of the first electrode E1 and the second electrode.

A capping layer covering the OLED may be disposed on the OLED, and a thin film encapsulation layer or an encapsulation substrate may be disposed on the OLED while interposing the capping layer therebetween.

Figure 4:
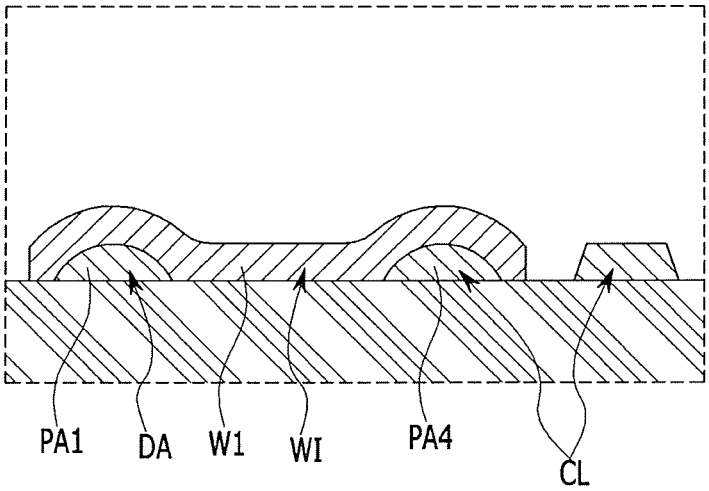
FIG. 4 is a cross-sectional view of FIG. 3 taken along line IV-IV according to an exemplary embodiment of the present invention.
Figure 5:
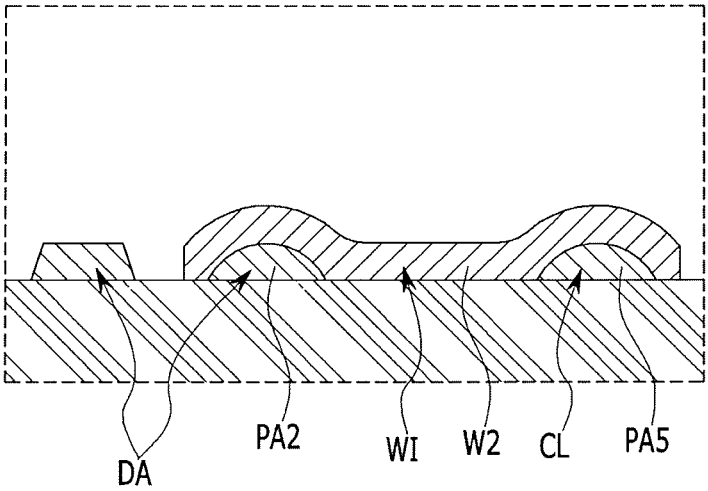
FIG. 5 is a cross-sectional view of FIG. 3 taken along line V-V according to an exemplary embodiment of the present invention.

Referring to FIGS. 3 to 5, the first pixel PX1 of the first, second, and third pixels PX1, PX2, and PX3, which further includes a wire WI compared to the second and third pixels PX2 and PX3, will be described in detail.

FIG. 4 is a cross-sectional view of FIG. 3 taken along line IV-IV according to an exemplary embodiment. FIG. 5 is a cross-sectional view of FIG. 3 taken along line V-V according to an exemplary embodiment. For convenience of description, FIGS. 4 and 5 respectively illustrate cross-sections of the data line DA, the connecting line CL, and the wire WI.

Referring to FIGS. 3 to 5, the first pixel PX1 corresponds to a pixel that is repaired by a method for repairing an OLED display, as described further below. The data line DA and the connecting line CL included in the first pixel PX1 have different structures than those of the second and third pixels PX2 and PX3.

In the example described herein, a pixel circuit PC of the first pixel PX1 may be different from each of the pixel circuits PC of the second and third pixels PX2 and PX3 in that it is faulty, and the pixel circuit PC of the first pixel PX1 is cut off from the OLED.

The first pixel PX1 further includes a wire WI that connects (e.g., directly connects) one portion of the data line DA to one portion of the connecting line CL. One or more surfaces of one portion of the data line DA and one portion of the connecting line CL contacting the wire WI are curved.

For example, in an exemplary embodiment, the data line DA of the first pixel PX1 includes a first portion PA1, a second portion PA2, and a third portion PA3, and the connecting line CL includes a fourth portion PA4, a fifth portion PA5, and a sixth portion PA6. The wire WI includes a first subwire W1 and a second subwire W2.

The first portion PA1 of the data line DA is connected to the fourth portion PA4 of the connecting line CL via the first subwire W1, and the first subwire W1 connects (e.g., directly connects) the first portion PA1 of the data line DA to the fourth portion PA4 of the connecting line CL, which are disposed on the same layer. The first subwire W1 is disposed on the data line DA and on the connecting line CL, and contacts (e.g., directly contacts) each of the data line DA and the connecting line CL.

The second portion PA2 of the data line DA is connected to the fifth portion PA5 of the connecting line CL via the second subwire W2, and the second subwire W2 connects (e.g., directly connects) the second portion PA2 of the data line DA to the fifth portion PA5 of the connecting line CL, which are disposed on the same layer. The second subwire W2 is disposed on the data line DA and on the connecting line CL, and contacts (e.g., directly contacts) each of the data line DA and the connecting line CL.

In an exemplary embodiment, surfaces of each of the first and second portions PA1 and PA2 of the data line DA connected by the first subwire W1 and each of the fourth and fifth portions PA4 and PA5 of the connecting line CL connected by the second subwire W2 are curved.

As a result, in an exemplary embodiment, since each of the first portion PA1 of the data line DA and the fourth portion PA4 of the connecting line CL that are directly connected to the first subwire W1 has a curved surface and directly contacts the first subwire W1, and a surface of each of the second portion PA2 of the data line DA and the fifth portion PA5 of the connecting line CL that are directly connected to the second subwire W2 is curved, each of the first and second subwires W1 and W2 efficiently connects the data line DA and the connecting line CL. For example, in a comparative example, when each of the surfaces of the connecting line CL and the data line DA to which the wire WI is directly connected has a corner, the wire WI may be undesirably cut off by the corner such that the data line DA and the connecting line CL are not connected by the wire WI. However, according to exemplary embodiments of the present invention, since the surfaces of each of the first and second portion PA1 and PA2 of the data line DA to which the wire WI is directly connected and each of the fourth and fifth portions PA4 and PA5 of the connecting line CL are curved, the wire WI disposed between the data line DA and the connecting line CL may efficiently connect the data line DA and the connecting line CL.

In an exemplary embodiment, a surface of the portion of the data line DA other than the first and second portions PA1 and PA2 has a corner while the first and second portions PA1 and PA2 do not have a corner, and a surface of the portion of the connecting line CL other than the fourth and fifth portions PA4 and PA5 of the connecting line CL has a corner, while the fourth and fifth portions PA4 and PA5 do not have a corner. That is, according to an exemplary embodiment, the surface of the first and second portions PA1 and PA2 of the data line DA and the fourth and fifth portions PA4 and PA5 of the connecting line CL has a round/circular shape that does not include any corners/sharp edges.

In an exemplary embodiment, the third portion PA3 disposed between the first and second portions PA1 and PA2 of the data line DA is cut off and isolated from the first and second portions PA1 and PA2 while being connected to the pixel circuit PC, and the fourth and fifth portions PA4 and PA5 of the connecting line CL, as well as the sixth portion PA6 therebetween, are cut off and isolated from the other portion.

Accordingly, the first portion PA1 of the data line DA of the first pixel PX1 is connected to the second portion PA2 of the data line DA via the first subwire W1, the fourth, sixth, and fifth portions PA4, PA6, and PA5 of the connecting line CL, and the second subwire W2. In addition, a data signal transmitted via the data line DA connected to the first pixel PX1 may be provided to another pixel disposed under the first pixel PX1 after bypassing the pixel circuit PC of the first pixel PX1 and passing thorough the first portion PA1 of the data line DA, the first subwire W1, the fourth, sixth, and fifth portions PA4, PA6, and PA5 of the connecting line CL, the second subwire W2, and the second portion PA2 of the data line DA.

That is, the pixel circuit PC of the faulty first pixel PX1 is not connected to the data line DA, and the data signal transmitted via the data line DA is provided to pixels other than the first pixel PX1 via the wire WI and the connecting line CL. Accordingly, when the plurality of pixels emit light, the first pixel PX1 does not emit light such that it is suppressed from being recognized.

That is, the faulty first pixel PX1 is repaired, and thus the OLED display capable of suppressing the faulty first pixel PX1 from being recognized is provided.

Referring to FIG. 6, effects of the OLED display according to an exemplary embodiment of the present invention will be described.

Figure 6A:
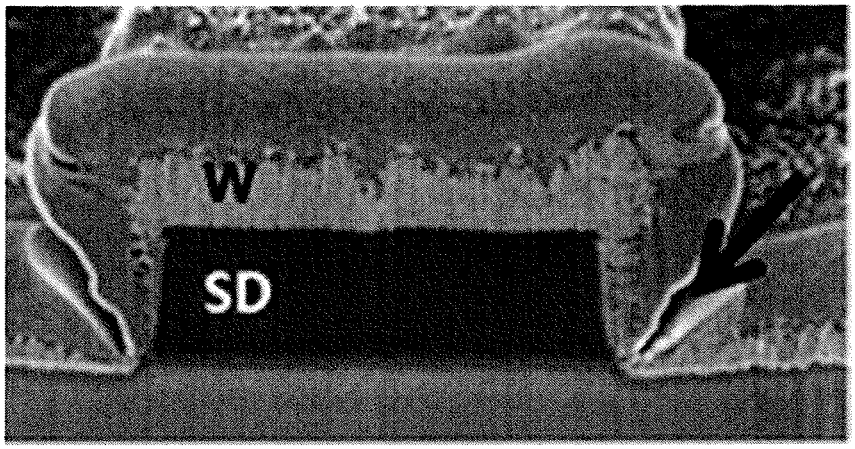
FIG. 6A illustrates a cross-section of a repaired part of a conventional OLED display according to a comparative example.
Figure 6B:
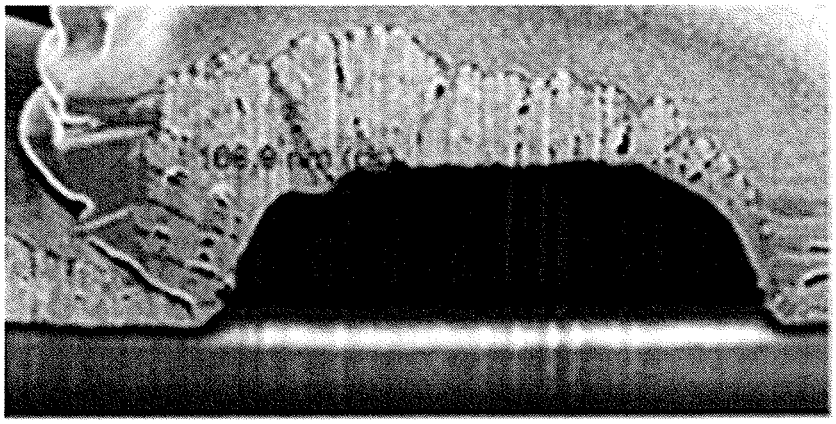
FIG. 6B illustrates a repaired part of an OLED display according to an exemplary embodiment of the present invention.

FIG. 6A illustrates a cross-section of a repaired part of a conventional OLED display according to a comparative example, and FIG. 6B illustrates a repaired part of an OLED display according to an exemplary embodiment of the present invention.

As shown in FIG. 6A, in a conventional OLED display according to a comparative example, since a surface of a data line SD directly contacting a wire W includes a corner, the wire W is undesirably cut off by the corner and the wire W is unable to connect the data line SD to a connecting line.

In contrast, as shown in FIG. 6B, in an exemplary embodiment, since the surface of the data line to which the wire is directly connected is curved, the wire efficiently connects the data line and the connecting line.

As described above, in the OLED display according to an exemplary embodiment of the present invention, one or more surfaces of one portion of the data line DA and one portion of the connecting line CL that contact the wire WI are curved, resulting in the wire WI efficiently connecting the data line DA to the connecting line CL. Thus, an OLED display allowing repair work to be more efficiently performed may be provided.

Figure 7:
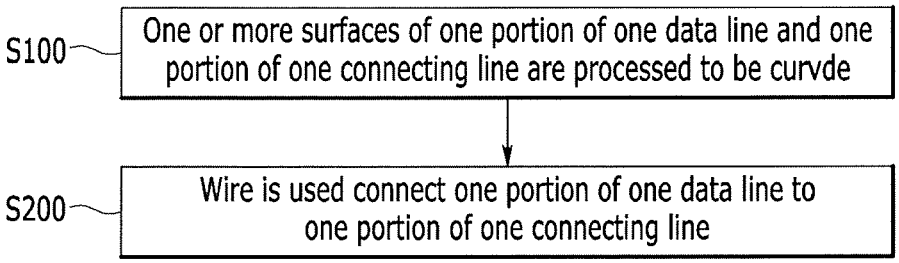
FIG. 7 is a flowchart showing a method for repairing an OLED display according to an exemplary embodiment of the present invention.
Figure 8:
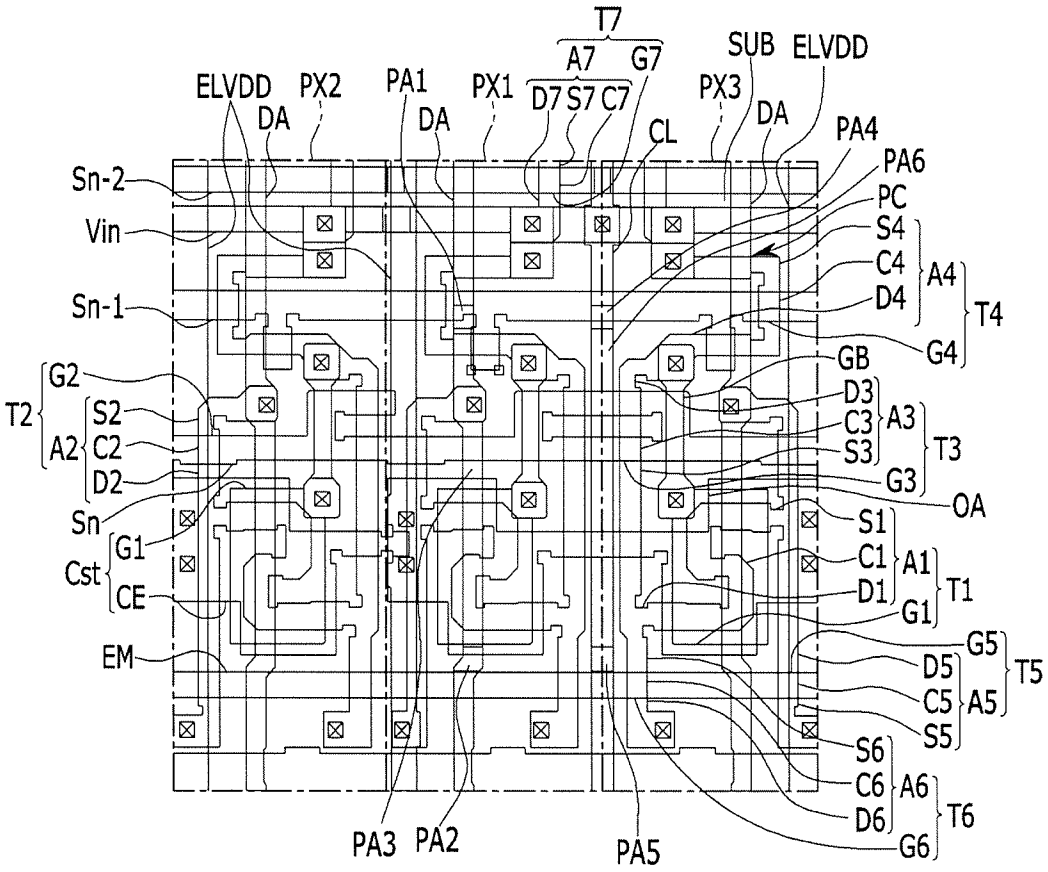
FIGS. 8 and 9 are layout views of first, second, and third pixels of a plurality of pixels of the OLED display used to describe a method for repairing the OLED display according to an exemplary embodiment of the present invention.
Figure 9:
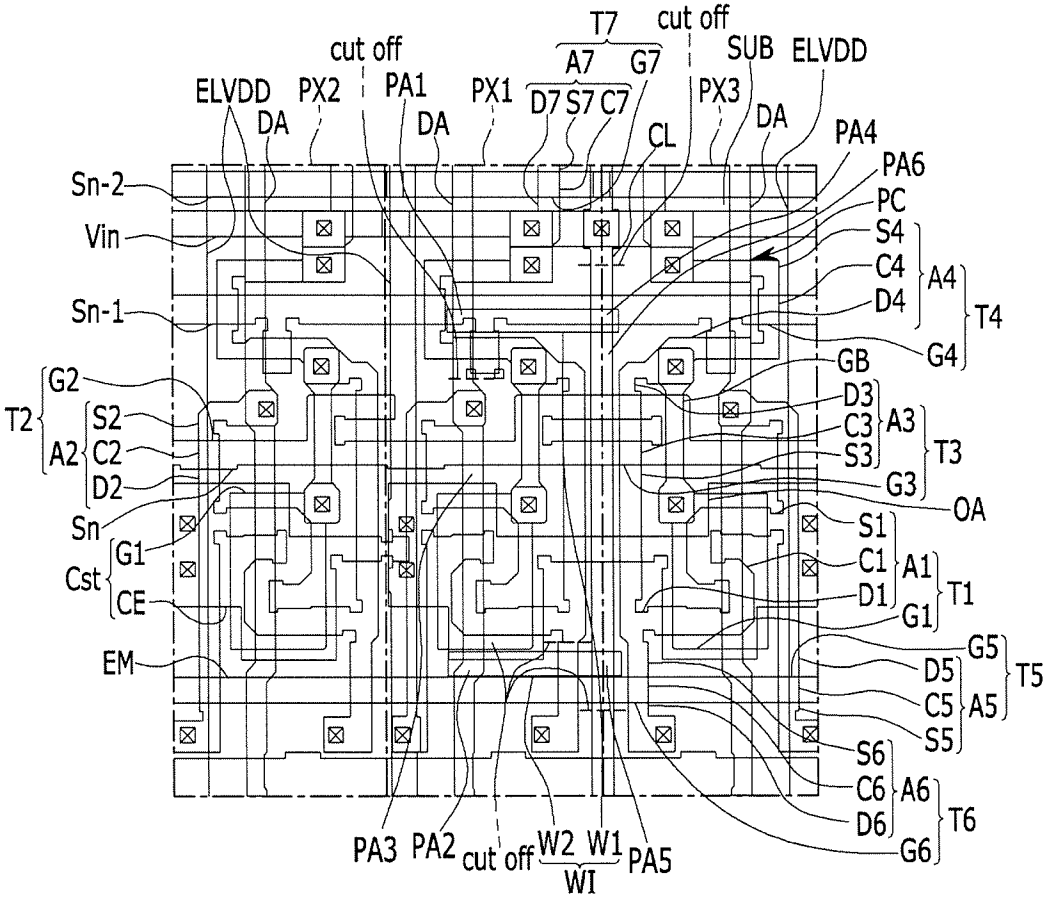

Referring to FIGS. 7 to 9, a repair method of an OLED display according to an exemplary embodiment of the present invention will be described. Using the repair method of an OLED display described herein, the above-described OLED display according to an exemplary embodiment may be provided.

FIG. 7 is a flowchart showing a repair method of an OLED display according to an exemplary embodiment. FIGS. 8 and 9 are layout views of first, second, and third pixels of a plurality of pixels of the OLED display used to describe the repair method of the OLED display according to the current exemplary embodiment.

As shown in FIGS. 7 and 8, one or more surfaces of one portion of one data line and one portion of one connecting line are processed to be curved (S100).

For example, in an exemplary embodiment, a lighting inspection may be performed to determine whether a pixel circuit PC including a plurality of thin film transistors T1, T2, T3, T4, T5, T6, and T7 of respective first, second, and third pixels PX1, PX2, and PX3, which are a plurality of pixels included in the OLED display, is faulty. If the first pixel PX1 of the first, second, and third pixels PX1, PX2, and PX3 is determined to be faulty, surfaces of each of first and second portions PA1 and PA2, which is one portion of one data line DA connected to one pixel circuit PC of the first pixel PX1, and each of fourth and fifth portions PA4 and PA5 of one connecting line CL neighboring one data line DA are processed to be curved.

For example, in an exemplary embodiment, using a laser beam, the surfaces of each of the first and second portions PA1 and PA2, which is one portion of the data line DA, and each of the fourth and fifth portions PA4 and PA5 of one connecting line CL may be processed to be curved. However, exemplary embodiments of the present invention are not limited thereto. For example, according to exemplary embodiments, various methods may be used to process the surfaces of each of the first and second portions PA1 and PA2 of the data line DA and each of the fourth and fifth portions PA4 and PA5 of the connecting line CL to be curved.

Next, as shown in FIG. 9, a wire is used to connect one portion of one data line to one portion of one connecting line (S200).

For example, a wire WI is used to connect one portion of one data line DA to one portion of one connecting line CL.

For example, in an exemplary embodiment, using a deposition process, a first subwire W1 is used to connect (e.g., directly connect) the first portion PA1 of the data line DA and the fourth portion PA4 of the connecting line CL, and a second subwire W2 is used to connect (e.g., directly connect) the second portion PA2 of the data line DA and the fifth portion PA5 of the connecting line CL.

In addition, a third portion PA3 between the first and second portions PA1 and PA2 of the data line DA of the first pixel PX1 is cut off and separated from the first and second portions PA1 and PA2 while being connected to one pixel circuit PC, and the fourth and fifth portions PA4 and PA5 of the connecting line CL and the sixth portion PA6 therebetween are cut off and isolated from the other portion.

As described above, using the repair method of the OLED display according to an exemplary embodiment, the above-described OLED display according to an exemplary embodiment may be provided.

In an exemplary embodiment, the data line DA is connected to the connecting line CL by the wire WI, and the data line DA may be connected to the driving power supply line ELVDD or another line that is disposed on the same layer as the data line DA by the wire WI.

As described above, in the repair method of the OLED display according to an exemplary embodiment, one or more surfaces of one portion of the data line DA and one portion of the connecting line CL are processed to be curved, and the wire WI is used to connect one portion of the data line DA and one portion of the connecting line CL that have the curved surfaces, resulting in the wire WI efficiently connecting the data line DA and the connecting line CL. That is, a repair method of the OLED display in which repair work may be efficiently performed by the wire WI is provided.

Figure 10:
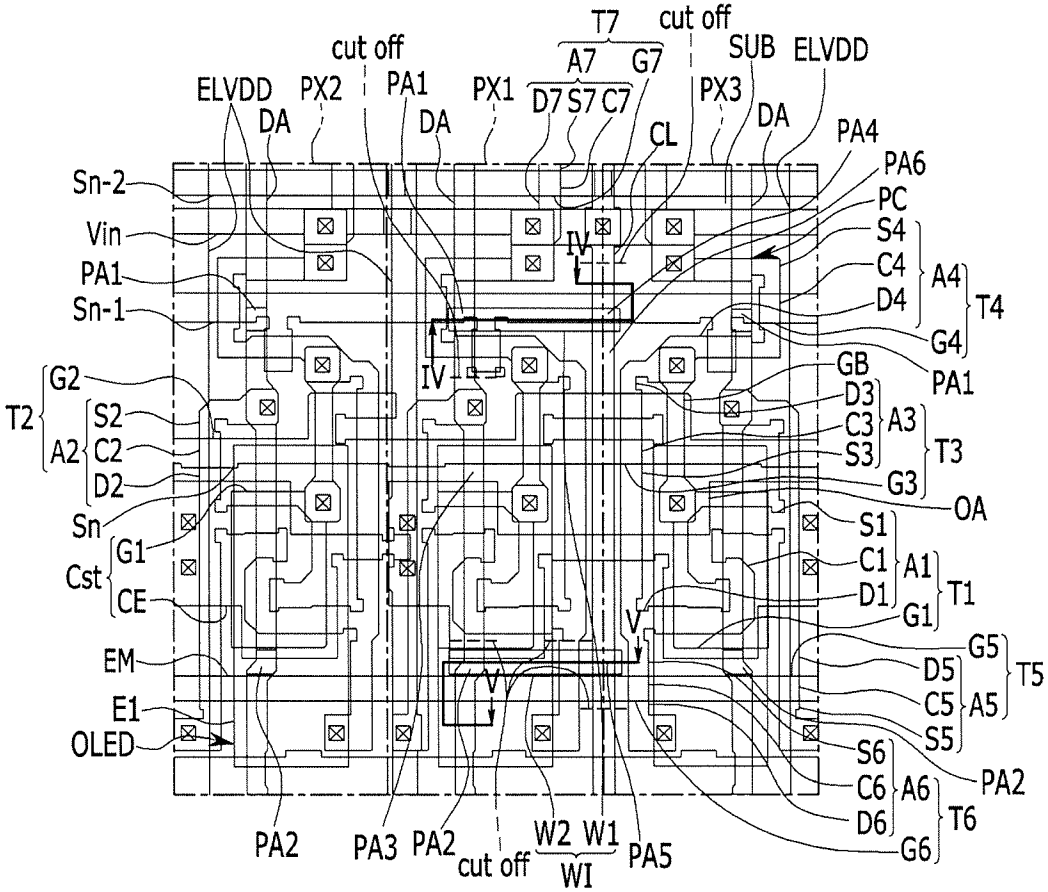
FIG. 10 is a layout view of first, second, and third pixels of a plurality of pixels of an OLED display according to an exemplary embodiment of the present invention.
Figure 11:
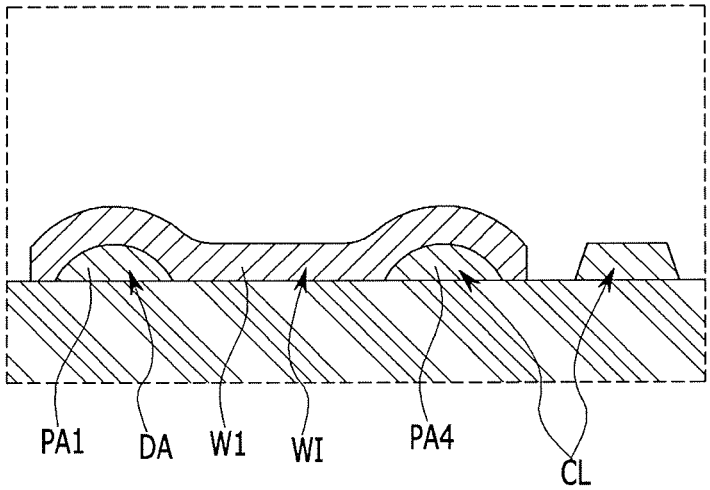
FIG. 11 is a cross-sectional view of FIG. 10 taken along line IV-IV according to an exemplary embodiment of the present invention.
Figure 12:
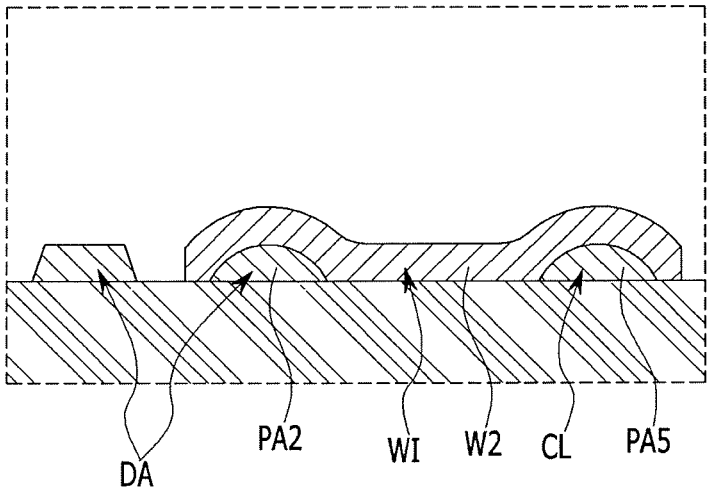
FIG. 12 is a cross-sectional view of FIG. 10 taken along line V-V according to an exemplary embodiment of the present invention.

Referring to FIGS. 10 to 12, an OLED display according to an exemplary embodiment of the present invention will be described.

Referring to FIG. 10, arrangements of first, second, and third pixels PX1, PX2, and PX3 of a plurality of pixels PXn of an OLED display according to an exemplary embodiment, which are disposed in a display area DIA of a substrate SUB to neighbor each other, will be described.

FIG. 10 is a layout view of first, second, and third pixels of a plurality of pixels of an OLED display according to an exemplary embodiment.

As shown in FIG. 10, the first, second, and third pixels PX1, PX2, and PX3 disposed on the substrate SUB to neighbor each other respectively include a first thin film transistor T1, a second thin film transistor T2, a third thin film transistor T3, a fourth thin film transistor T4, a fifth thin film transistor T5, a sixth thin film transistor T6, a seventh thin film transistor T7, a first scan line Sn, a second scan line Sn-1, a third scan line Sn-2, a light emission control line EM, a capacitor Cst, a data line DA, a driving power supply line ELVDD, a gate bridge GB, a connecting line CL, an initialization power supply line Vin, and an OLED. Here, the first pixel PX1 is different from the second and third pixels PX2 and PX3 in that it further includes a wire WI.

The first, second, third, fourth, fifth, sixth, and seventh thin film transistors Ti, T2, T3, T4, T5, T6, and T7, which are a plurality of thin film transistors of the respective first, second, and third pixels PX1, PX2, and PX3, the gate bridge GB, and the capacitor Cst, may form a pixel circuit PC.

The first thin film transistor T1 is disposed on the substrate SUB, and includes a first active layer A1 and a first gate electrode G1.

The first active layer A1 includes a first source electrode S1, a first channel C1, and a first drain electrode D1. The first source electrode S1 is connected to each of a second drain electrode D2 of the second thin film transistor T2 and a fifth drain electrode D5 of the fifth thin film transistor T5. The first drain electrode D1 is connected to each of a third source electrode S3 of the third thin film transistor T3 and a sixth source electrode S6 of the sixth thin film transistor T6. The first channel C1, which is a channel region of the first active layer A1 overlapping the first gate electrode G1, is bent at least once to extend, and a wide driving range of a gate voltage may be applied to a first gate electrode G1, since the first channel C1 is bent at least once to extend within a limited space overlapping the first gate electrode G1 such that a length of the first channel C1 is extended. Accordingly, the gate voltage applied to the first gate electrode G1 may be varied within the wide driving range to more precisely control a gray level of light emitted from the OLED, thereby improving the quality of images displayed on the OLED display. The first active layer A1 may be modified to have various shapes, such as, for example, a 'reverse S', 'S', 'M', 'W', etc.

The first active layer A1 may be formed of, for example, polysilicon or an oxide semiconductor. The oxide semiconductor may include one of the oxides based on, for example, titanium (Ti), hafnium (Hf), zirconium (Zr), aluminum (Al), tantalum (Ta), germanium (Ge), zinc (Zn), gallium (Ga), tin (Sn), or indium (In), and complex oxides thereof such as, for example, zinc oxide (ZnO), indium-gallium-zinc oxide (InGaZnO4), indium-zinc oxide (Zn—In—O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O). In an exemplary embodiment, when the first active layer A1 is formed of an oxide semiconductor, a separate passivation layer may be added to protect the oxide semiconductor, which may be vulnerable to elements from an external environment such as, for example, high temperature and the like.

The first channel C1 of the first active layer A1 may be channel-doped with an N or P-type impurity. The first source electrode S1 and the first drain electrode D1 are separated from each other while interposing the first channel C1 therebetween and may be doped with an opposite type of doping impurity to a doping impurity doped in the first channel C1.

The first gate electrode G1 is disposed on the first channel C1 of the first active layer A1, and is in the shape of an island. The first gate electrode G1 is connected to the fourth drain electrode D4 of the fourth thin film transistor T4 and the third drain electrode D3 of the third thin film transistor T3 by a gate bridge GB through which the contact hole CNT is connected. The first gate electrode G1 overlaps a capacitor electrode CE, and may serve as both the gate electrode of the first thin film transistor T1 and the other electrode of the capacitor Cst. That is, the first gate electrode G1 forms the capacitor Cst along with the capacitor electrode CE.

The second thin film transistor T2 is disposed on the substrate SUB, and includes a second active layer A2 and the second gate electrode G2. The second active layer A2 includes a second source electrode S2, a second channel C2, and a second drain electrode D2. The second source electrode S2 is connected to the data line DA via the contact hole, and the second drain electrode D2 is connected to the first source electrode S1 of the first thin film transistor T1. The second channel C2, which is a channel region of the second active layer A2 overlapping the second gate electrode G2, is disposed between the second source electrode S2 and the second drain electrode D2. That is, the second active layer A2 is connected to the first active layer A1.

The second channel C2 of the second active layer A2 may be channel-doped with an N or P-type impurity. The second source electrode S2 and the second drain electrode D2 may be separated from each other while interposing the first channel C1 therebetween to be doped with an opposite type of doping impurity to a doping impurity doped in the first channel C1. The second active layer A2 is disposed on the same layer, formed of the same material, and integrally formed with the first active layer A1.

The second gate electrode G2 is disposed on the second channel C2 of the second active layer A2, and is integrally formed with the first scan line Sn.

The third thin film transistor T3 is disposed on the substrate SUB, and includes a third active layer A3 and a third gate electrode G3.

The third active layer A3 includes the third source electrode S3, a third channel C3, and the third drain electrode D3. The third source electrode S3 is connected to the first drain electrode D1, and the third drain electrode D3 is connected to the first gate electrode G1 of the first thin film transistor T1 by the gate bridge GB through which the contact hole is reached. The third channel C3, which is a channel region of the third active layer A3 overlapping the third gate electrode G3, is disposed between the third source electrode S3 and the third drain electrode D3. That is, the third active layer A3 connects the first active layer A1 to the first gate electrode G1.

The third channel C3 of the third active layer A3 may be channel-doped with an N or P-type impurity. The third source electrode S3 and the third drain electrode D3 are separated from each other while interposing the third channel C3 therebetween to be doped with an opposite type of doping impurity to a doping impurity doped in the third channel C3. The third active layer A3 is formed on the same layer, formed of the same material, and integrally formed with the first and second active layers A1 and A2.

The third gate electrode G3 is disposed on the third channel C3 of the third active layer A3, and is integrally formed with the first scan line Sn. The third gate electrode G3 is formed as a dual gate electrode.

The fourth thin film transistor T4 is disposed on the substrate SUB, and includes a fourth active layer A4 and a fourth gate electrode G4.

The fourth active layer A4 includes a fourth source electrode S4, a fourth channel C4, and the fourth drain electrode D4. The fourth source electrode S4 is connected to the initialization power supply line that is connected to the connecting line CL via the contact hole, and the fourth drain electrode D4 is connected to the first gate electrode G1 of the first thin film transistor T1 via the gate bridge GB through which the contact hole is reached. The fourth channel C4, which is a channel region of the fourth active layer A4 overlapping the fourth gate electrode G4, is disposed between the fourth source electrode S4 and the fourth drain electrode D4. That is, the fourth active layer A4 connects the initialization power supply line Vin to the first gate electrode G1 while being connected to each of the third active layer A3 and the first gate electrode G1.

The fourth channel C4 of the fourth active layer A4 may be channel-doped with an N or P-type impurity. The fourth source electrode S4 and the fourth drain electrode D4 may be separated from each other while interposing the fourth channel C4 therebetween to be doped with an opposite type of doping impurity to a doping impurity doped in the fourth channel C4. The fourth active layer A4 is disposed on the same layer, formed of the same material, and integrally formed with the first, second, and third active layers A1, A2, and A3.

The fourth gate electrode G4 is disposed on the fourth channel C4 of the fourth active layer A4, and is integrally formed with the second scan line Sn-1. The fourth gate electrode G4 is formed as a dual gate electrode.

The fifth thin film transistor T5 is disposed on the substrate SUB, and includes a fifth active layer A5 and a fifth gate electrode G5.

The fifth active layer A5 includes a fifth source electrode S5, a fifth channel C5, and the fifth drain electrode D5. The fifth source electrode S5 is connected to the driving power supply line ELVDD via the contact hole, and the fifth drain electrode D5 is connected to the first source electrode S1 of the first thin film transistor Ti. The fifth channel C5, which is a channel region of the fifth active layer A5 overlapping the fifth gate electrode G5, is disposed between the fifth source electrode S5 and the fifth drain electrode D5. That is, the fifth active layer A5 connects the driving power supply line ELVDD to the first active layer A1.

The fifth channel C5 of the fifth active layer A5 may be channel-doped with an N or P-type impurity. The fifth source electrode S5 and the fifth drain electrode D5 are separated from each other while interposing the fifth channel C5 to be doped with an opposite type of doping impurity to a doping impurity doped in the fifth channel C5. The fifth active layer A5 is disposed on the same layer as, formed of the same material as, and integrally formed with the first, second, third, and fourth active layers A1, A2, A3, and A4.

The fifth gate electrode G5 is disposed on the fifth channel C5 of the fifth active layer A5, and is integrally formed with the light emission control line EM.

The sixth thin film transistor T6 is disposed on the substrate SUB, and includes a sixth active layer A6 and a sixth gate electrode G6.

The sixth active layer A6 includes the sixth source electrode S6, a sixth channel C6, and a sixth drain electrode D6. The sixth source electrode S6 is connected to the first drain electrode D1 of the first thin film transistor T1, and the sixth drain electrode D6 is connected to a first electrode E1 of the OLED via the contact hole. The sixth channel C6, which is a channel region of the sixth active layer A6 overlapping the sixth gate electrode G6, is disposed between the sixth source electrode S6 and the sixth drain electrode D6. That is, the sixth active layer A6 connects the first active layer A1 to the first electrode E1 of the OLED.

The sixth channel C6 of the sixth active layer A6 may be channel-doped with an N or P-type impurity. The sixth source electrode S6 and the sixth drain electrode D6 are separated from each other while interposing the sixth channel C6 therebetween to be doped with an opposite type of doping impurity to a doping impurity doped in the sixth channel C6. The sixth active layer A6 is formed on the same layer, formed of the same material, and integrally formed with the first, second, third, fourth, and fifth active layers A1, A2, A3, A4, and A5.

The sixth gate electrode G6 is disposed on the sixth channel C6 of the sixth active layer A6, and is integrally formed with the light emission control line EM.

The seventh thin film transistor T7 is disposed on the substrate SUB, and includes a seventh active layer A7 and a seventh gate electrode G7.

The seventh active layer A7 includes a seventh source electrode S7, a seventh channel C7, and a seventh drain electrode D7. The seventh source electrode S7 may be connected to a first electrode of an OLED of another pixel not shown in FIG. 10 (e.g., a pixel disposed above the pixel illustrated in FIG. 10), and the seventh drain electrode D7 is connected to the fourth source electrode S4 of the fourth thin film transistor T4. The seventh channel C7, which is a channel region of the seventh active layer A7 overlapping the seventh gate electrode G7, is disposed between the seventh source electrode S7 and the seventh drain electrode D7. That is, the seventh active layer A7 connects the first electrode of the OLED to the fourth active layer A4.

The seventh channel C7 of the seventh active layer A7 may be channel-doped with an N or P-type impurity. The seventh source electrode S7 and the seventh drain electrode D7 are separated from each other while interposing the seventh channel C7 therebetween to be doped with an opposite type of doping impurity to a doping impurity doped in the seventh channel C7. The seventh active layer A7 is disposed on the same layer, formed of the same material, and integrally formed with the first, second, third, fourth, fifth and sixth active layers A1, A2, A3, A4, and A5, and A6.

The seventh gate electrode G7 is disposed on the seventh channel C7 of the seventh active layer A7, and is integrally formed with the third scan line Sn-2.

The first scan line Sn is disposed on the second and third active layers A2 and A3 to extend in a direction crossing the second and third active layers A2 and A3, and is integrally formed with and connected to the second and third gate electrodes G2 and G3.

The second scan line Sn-1 is disposed on the fourth active layer A4 while being separated from the first scan line Sn, extends in a direction crossing the fourth active layer A4, and is integrally formed with and connected to the fourth gate electrode G4.

The third scan line Sn-2 is disposed on the seventh active layer A7 while being separated from the second scan line Sn-1, extends in a direction crossing the seventh active layer A7, and is integrally formed with and connected to the seventh gate electrode G7.

The light emission control line EM is disposed on the fifth and sixth active layers A5 and A6 while being separated from the first scan line Sn, extends in a direction crossing the fifth and sixth active layers A5 and A6, and is integrally formed with and connected to the fifth and sixth gate electrodes G5 and G6.

In an exemplary embodiment, the light emission control line EM, the third scan line Sn-2, the second scan line Sn-1, the first scan line Sn, the first gate electrode G1, the second gate electrode G2, the third gate electrode G3, the fourth gate electrode G4, the fifth gate electrode G5, the sixth gate electrode G6, and the seventh gate electrode G7, which are described above, are disposed on the same layer and are formed of the same material. In an exemplary embodiment, the light emission control line EM, the third scan line Sn-2, the second scan line Sn-1, the first scan line Sn, the first gate electrode G1, the second gate electrode G2, the third gate electrode G3, the fourth gate electrode G4, the fifth gate electrode G5, the sixth gate electrode G6, and the seventh gate electrode G7 may respectively be selectively disposed on different layers and may be formed of different materials.

The capacitor Cst includes one electrode and another electrode that face each other while interposing an insulating layer therebetween. One electrode described above may be the capacitor electrode CE, and the other electrode may be the first gate electrode G1. The capacitor electrode CE is disposed on the first gate electrode G1, and is connected to the driving power supply line ELVDD via the contact hole.

The capacitor electrode CE forms the capacitor Cst along with the first gate electrode G1. The first gate electrode G1 and the capacitor electrode CE are respectively formed of different metals or the same metal on different layers.

The capacitor electrode CE includes an opening OA that exposes part of the first gate electrode G1. The gate bridge GB is connected to the first gate electrode G1 via the opening OA.

The data line DA is disposed on the first scan line Sn to extend in one direction crossing the first scan line Sn, and the plurality of data lines DA are respectively disposed in the other direction crossing the one direction while being separated from each other. The data line DA is connected to the second source electrode S2 of the second active layer A2 via the contact hole. The data line DA extends to cross the first scan line Sn, the second scan line Sn-1, the third scan line Sn-2, the light emission control line EM, and the initialization power supply line Vin.

The driving power supply line ELVDD is separated from the data line DA and is disposed on the first scan line Sn to extend in one direction crossing the first scan line Sn, and is connected to the fifth source electrode S5 of the fifth active layer A5 that is connected to the capacitor electrode CE and the first active layer A1 via the contact hole. The driving power supply line ELVDD extends to cross the first scan line Sn, the second scan line Sn-1, the third scan line Sn-2, the light emission control line EM, and the initialization power supply line Vin.

The gate bridge GB is separated from the driving power supply line ELVDD, and is connected to each of the third drain electrode D3 of the third active layer A3 and the fourth drain electrode D4 of the fourth active layer A4 via the contact hole such that it is connected to the first gate electrode G1 exposed by the opening OA of the capacitor electrode CE via the contact hole. That is, the gate bridge GB respectively connects the first thin film transistor T1 to the third thin film transistor T3 and to the fourth thin film transistor T4.

The connecting line CL is disposed between the neighboring data lines DA, and extends in a direction substantially parallel to the one direction in which the data line DA extends. The connecting line CL is connected to the initialization power supply line Vin, and is connected to each of the first, second, and third pixels PX1, PX2, and PX3 via the initialization power supply line Vin. Since the connecting line CL extends in a direction substantially parallel to the one direction and the initialization power supply line Vin extends in a direction crossing the connecting line CL, the connecting line CL and the initialization power supply line Vin have a planar matrix form across the entire substrate SUB.

The connecting line CL is disposed on the same layer as the gate bridge GB, the data line DA, and the driving power supply line ELVDD, which are described above, and is formed of the same material. In an exemplary embodiment, the connecting line CL, the data line DA, the driving power supply line ELVDD, and the gate bridge GB may respectively be selectively disposed on different layers and may be formed of different materials.

In an exemplary embodiment, the initialization power supply line Vin extends in a direction crossing an extending direction of the connecting line CL, and extends in a direction substantially parallel to the other direction described above in which the plurality of data lines DA are respectively arranged. The initialization power supply line Vin is connected to the connecting line CL via the contact hole and is also connected to the fourth source electrode S4 of the fourth active layer A4 via the contact hole. The initialization power supply line Vin is disposed on the same layer as the capacitor electrode CE and is formed of the same material as the capacitor electrode CE. In an exemplary embodiment, the initialization power supply line Vin may be disposed on a different layer than the capacitor electrode CE, and may be formed of a different material.

The OLED includes the first electrode E1, an organic emission layer, and a second electrode. The first electrode E1 is connected to the sixth drain electrode D6 of the sixth thin film transistor T6 via the contact hole. The first electrode E1, the organic emission layer, and the second electrode may be sequentially laminated. One or more of the first electrode E1 and the second electrode may be at least any one of a light transmissive electrode, a light reflective electrode, and a light transflective electrode, and light radiated from the organic emission layer may be emitted toward one or more of the first electrode E1 and the second electrode.

A capping layer covering the OLED may be disposed on the OLED, and a thin film encapsulation layer or an encapsulation substrate may be disposed on the OLED while interposing the capping layer therebetween.

Referring to FIGS. 10 to 12, the first pixel PX1 of the first, second, and third pixels PX1, PX2, and PX3, which further includes a wire WI compared to the second and third pixels PX2 and PX3, will be described in detail.

FIG. 11 is a cross-sectional view of FIG. 10 taken along line IV-IV according to an exemplary embodiment. FIG. 12 is a cross-sectional view of FIG. 10 taken along line V-V according to an exemplary embodiment. FIGS. 11 and 12 respectively illustrate cross-sections of the data line DA, the connecting line CL, and the wire WI for convenience of description.

As shown in FIGS. 10 to 12, the first pixel PX1 is a pixel that is repaired by a repair method of an OLED display to be described below, and the data line DA and the connecting line CL included in the first pixel PX1 have different structures than those of the second and third pixels PX2 and PX3 and have middle portions cut off Surfaces of the data line DA and the connecting line CL included in each of the first, second, and third pixels PX1, PX2, and PX3 have the same shape.

In the example described herein, a pixel circuit PC of the first pixel PX1 may be different from each of the pixel circuits PC of the second and third pixels PX2 and PX3 in that it is faulty, and the pixel circuit PC of the first pixel PX1 is cut off from the OLED.

The first pixel PX1 further includes a wire WI that connects (e.g., directly connects) one portion of the data line DA to one portion of the connecting line CL. One or more surfaces of one portion of the data line DA and one portion of the connecting line CL that contact the wire WI are curved.

In addition, a surface of one portion of each of the plurality of data lines DA connected to each of the second and third pixels PX2 and PX3 corresponding to one portion of one data line DA connected to the first pixel PX1 is curved.

In addition, a surface of one portion of each of the plurality of connecting lines CL corresponding to one portion of one connecting line CL connected to the first pixel PX1 is also curved.

For example, the data line DA of the first pixel PX1 includes a first portion PA1, a second portion PA2, and a third portion PA3, and the connecting line CL includes a fourth portion PA4, a fifth portion PA5, and a sixth portion PA6. The wire WI includes a first subwire W1 and a second subwire W2.

The first portion PA1 of the data line DA is connected to the fourth portion PA4 of the connecting line CL via the first subwire W1, and the first subwire W1 connects (e.g., directly connects) the first portion PA1 of the data line DA and the fourth portion PA4 of the connecting line CL that are disposed on the same layer. The first subwire W1 is disposed on the data line DA and on the connecting line CL, and contacts (e.g., directly contacts) each of the data line DA and the connecting line CL.

The second portion PA2 of the data line DA is connected to the fifth portion PA5 of the connecting line CL via the second subwire W2, and the second subwire W2 connects (e.g., directly connects) the second portion PA2 of the data line DA to the fifth portion PA5 of the connecting line CL that are disposed on the same layer. The second subwire W2 is disposed on the data line DA and on the connecting line CL, and contacts (e.g., directly contacts) each of the data line DA and the connecting line CL.

Surfaces of each of the first and second portions PA1 and PA2 of the data line DA connected by the first subwire W1 and each of the fourth and fifth portions PA4 and PA5 of the connecting line CL connected by the second subwire W2 are curved. Similarly, a surface of each of the first and second portions PA1 and PA2 of each of the plurality of data lines DA is also curved, and a surface of each of the fourth and fifth portions PA4 and PA5 of each of the plurality of connecting lines CL is also curved.

As such, the surface of each of the first portion PA1 of the data line DA and the fourth portion PA4 of the connecting line CL that are directly connected to the first subwire W1 is curved to directly contact the first subwire W1, and the surface of each of the second portion PA2 of the data line DA and the fifth portion PA5 of the connecting line CL that are directly connected to the second subwire W2 is curved. As a result, each of the first and second subwires W1 and W2 efficiently connects the data line DA to the connecting line CL. For example, in a comparative example, when each of the surfaces of the connecting line CL and the data line DA to which the wire WI is directly connected has a corner, the wire WI is undesirably cut off by the corner such that the connection between the data line DA and the connecting line CL may not be performed by the wire WI. However, according to exemplary embodiments of the present invention, the wire WI efficiently connects the data line DA to the connecting line CL since the surfaces of each of the first and second portion PA1 and PA2 of the data line DA to which the wire WI is directly connected and each of the fourth and fifth portions PA4 and PA5 of the connecting line CL are curved.

In an exemplary embodiment, a surface of the portion of the data line DA other than the first and second portions PA1 and PA2 has a corner, while the first and second portions PA1 and PA2 do not have a corner, and a surface of the portion of the connecting line CL other than the fourth and fifth portions PA4 and PA5 of the connecting line CL has a corner, while the fourth and fifth portions PA4 and PA5 do not have a corner. That is, according to an exemplary embodiment, the surface of the first and second portions PA1 and PA2 of the data line DA and the fourth and fifth portions PA4 and PA5 of the connecting line CL has a round/circular shape that does not include any corners/sharp edges.

In an exemplary embodiment, the third portion PA3 disposed between the first and second portions PA1 and PA2 of the data line DA is cut off and isolated from the first and second portions PA1 and PA2 while being connected to the pixel circuit PC, and the fourth and fifth portions PA4 and PA5 of the connecting line CL and the sixth portion PA6 positioned between the fourth and fifth portions are cut off and isolated from the other portion.

Accordingly, the first portion PA1 of the data line DA of the first pixel PX1 is connected to the second portion PA2 of the data line DA via the first subwire W1, the fourth, sixth, and fifth portions PA4, PA6, and PA5 of the connecting line CL, and the second subwire W2. In addition, a data signal transmitted via the data line DA connected to the first pixel PX1 may be provided to another pixel below the first pixel PX1 after bypassing the pixel circuit PC of the first pixel PX1 and passing through the first portion PA1 of the data line DA, the first subwire W1, the fourth, sixth, and fifth portions PA4, PA6, and PA5 of the connecting line CL, the second subwire W2, and the second portion PA2 of the data line DA.

That is, the pixel circuit PC of the faulty first pixel PX1 is not connected to the data line DA. Thus, the data signal transmitted via the data line DA is provided via the wire WI and the connecting line CL to a pixel other than the first pixel PX1. Accordingly, when the plurality of pixels radiate light, the first pixel PX1 does not radiate light and is therefore suppressed from being recognized.

That is, the faulty first pixel PX1 is repaired, and thus the OLED display capable of suppressing the faulty first pixel PX1 from being recognized is provided.

In a conventional OLED display according to a comparative example, since a surface of the data line directly contacting the wire includes a corner, the wire is undesirably cut off by the corner and the connection between the data line and the connecting line is not performed by the wire.

However, in exemplary embodiments of the present invention, the wire efficiently connects the data line to the connecting line since the surface of the data line to which the wire is directly connected is curved.

As described above, in the OLED display according to an exemplary embodiment, the wire WI efficiently connects the data line DA to the connecting line CL since one or more surfaces of one portion of the data line DA and one portion of the connecting line CL that contact the wire WI are curved. Thus, an OLED allowing repair work to be more efficiently performed may be provided.

In addition, in the OLED display according to an exemplary embodiment, each of the surfaces of one portion of one data line DA and one portion of one connecting line CL that are connected by the wire WI is curved, and each of the surfaces of one portion of each of the plurality of data lines DA corresponding to one portion of one data line DA and one portion of each of the plurality of connecting lines CL corresponding to one portion of one connecting line CL is also curved. As a result, each of the surfaces of the data line DA and the connecting line CL is not required to be curvedly processed before the wire WI is used to connect the data line DA to the connecting line CL.

Thus, an OLED display allowing repair work to be more efficiently performed may be provided.

Figure 13:
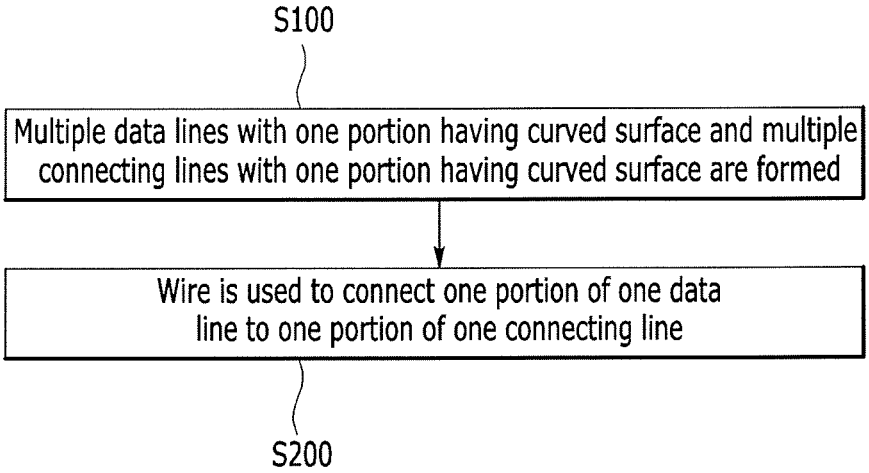
FIG. 13 is a flowchart showing a method for repairing an OLED display according to an exemplary embodiment of the present invention.
Figure 14:
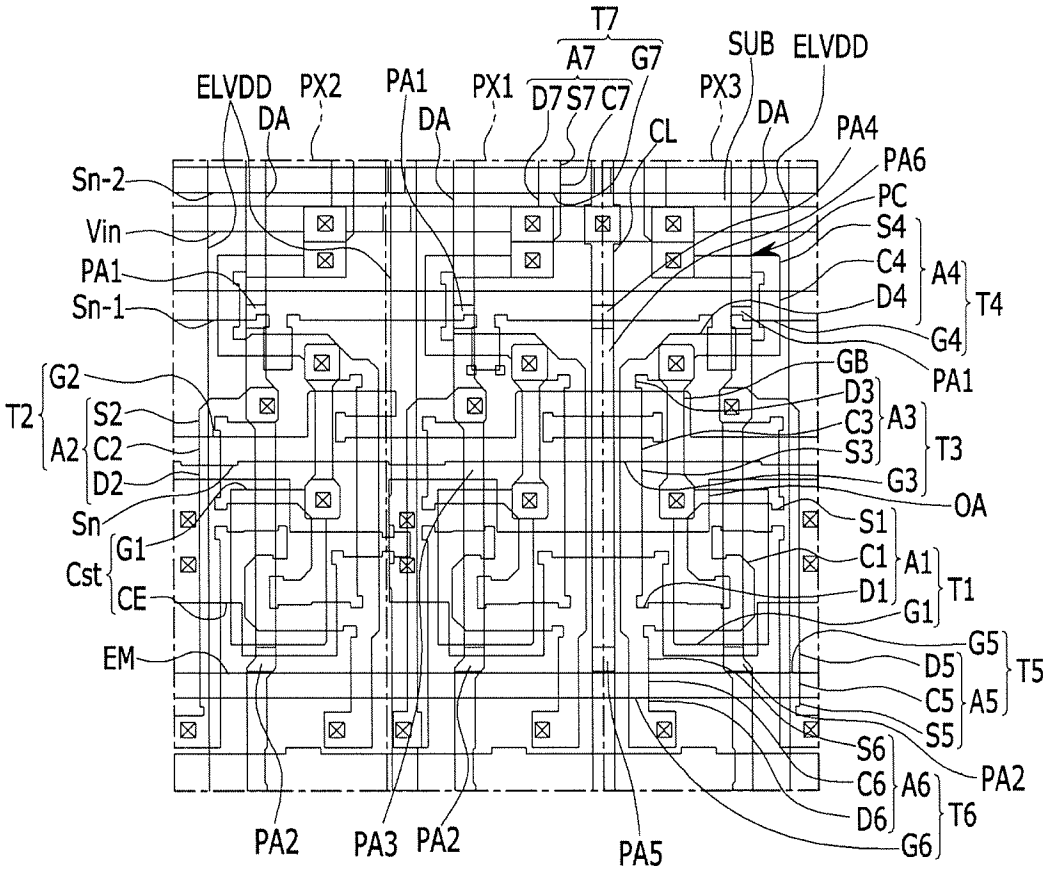
FIGS. 14 and 15 are layout views of first, second, and third pixels of a plurality of pixels of an OLED display used to describe the method for repairing an OLED display according to an exemplary embodiment of the present invention.
Figure 15:
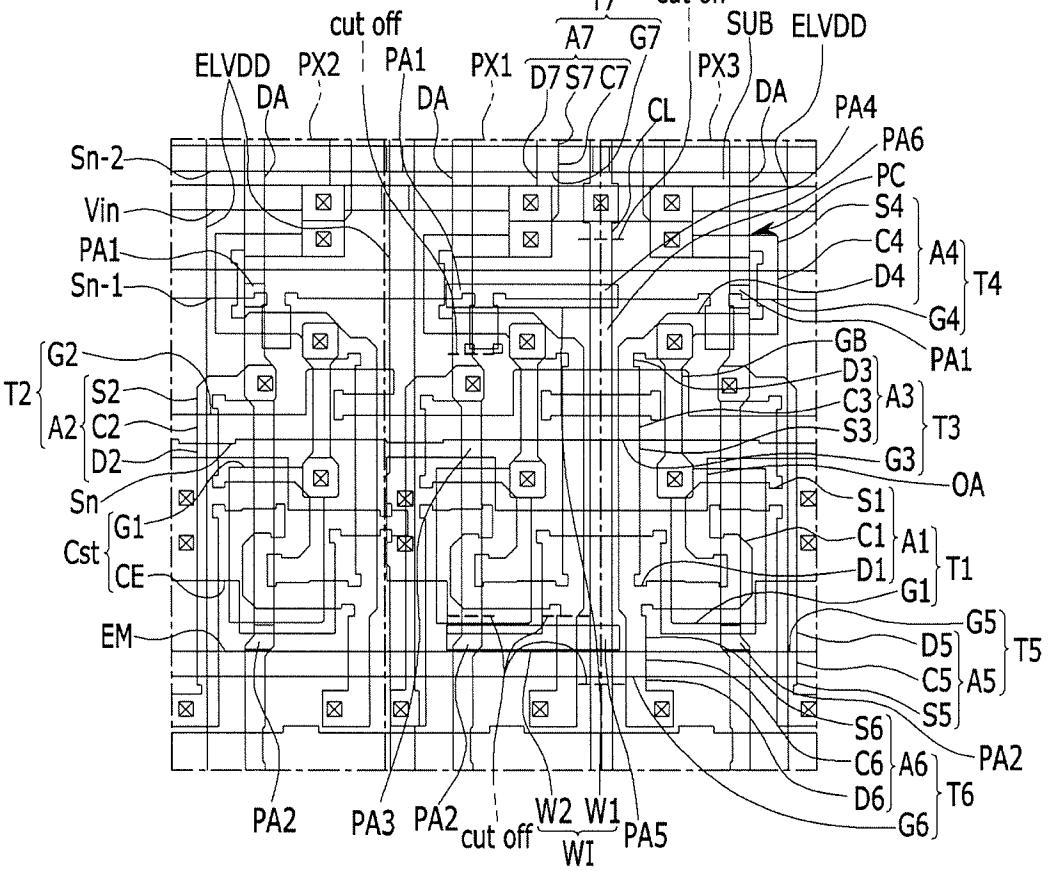

Referring to FIGS. 13 to 15, a repair method of an OLED display according to an exemplary embodiment will be described. Using the repair method of the OLED display according to the current exemplary embodiment, the above-described OLED display according to the exemplary embodiment may be provided.

FIG. 13 is a flowchart showing a repair method of an OLED display according to an exemplary embodiment. FIGS. 14 and 15 are layout views of first, second, and third pixels of a plurality of pixels of the OLED display used to describe a method for repairing the OLED display according to an exemplary embodiment.

First, as shown in FIGS. 13 and 14, a plurality of data lines with one portion having a curved surface and a plurality of connecting lines with one portion having a curved surface are formed (S100).

For example, when the plurality of data lines DA and the plurality of connecting lines CL are formed during manufacturing of the OLED display, surfaces of each of first and second portions PA1 and PA2 of each of the plurality of data lines DA and each of fourth and fifth portions PA4 and PA5 are formed to be curved.

For example, in an exemplary embodiment, when the plurality of data lines DA and the plurality of connecting lines CL are formed using a photolithography process, the surface of each of the first and second portions PA1 and PA2 is formed to be curved using a halftone mask, and the surface of each of the fourth and fifth portions PA4 and PA5 of the plurality of connecting lines CL is formed to be curved using a halftone mask.

Next, as shown in FIG. 15, a wire is used to connect one portion of one data line to one portion of one connecting line (S200).

For example, in an exemplary embodiment, after performing a lighting inspection to determine whether a pixel circuit PC including a plurality of thin film transistors T1, T2, T3, T4, T5, T6, and T7 of each of first, second, and third pixels PX1, PX2, and PX3, which are a plurality of pixels included in the OLED display, is faulty, when the first pixel PX1 of the first, second, and third pixels PX1, PX2, and PX3 is determined to be a faulty pixel, a wire WI is used to connect one portion of one data line DA connected to the pixel circuit PC of the first pixel PX1, which is one pixel circuit, to one portion of one connecting line CL.

For example, in an exemplary embodiment, using a deposition process, a first subwire W1 is used to directly connect the first portion PA1 of the data line DA to the fourth portion PA4 of the connecting line CL, and a second subwire W2 is used to directly connect the second portion PA2 of the data line DA to the fifth portion PA5 of the connecting line CL.

In addition, the third portion PA3 between the first and second portions PA1 and PA2 of the data line DA of the first pixel PX1 is cut off and separated from the first and second portions PA1 and PA2 while being connected to one pixel circuit PC, and the fourth and fifth portions PA4 and PA5 of the connecting line CL and the sixth portion PA6 therebetween are cut off and isolated from the other portion.

As described above, using the repair method of the OLED display according to the current exemplary embodiment, the above-described OLED display according to the exemplary embodiment may be provided.

In an exemplary embodiment, the data line DA is connected to the connecting line CL by the wire WI. In an exemplary embodiment, the data line DA may be connected to other lines and the like by wires that are disposed on the same layer as the driving power supply line ELVDD or the data line DA. In this case, a surface of one portion of the driving power supply line ELVDD corresponding to the first and second portions PA1 and PA2 of the data line DA may be formed to be curved, and a surface of one portion of the other line corresponding to the first and second portions PA1 and PA2 of the data line DA may be formed to be curved.

As described above, in the repair method of the OLED display according to the current exemplary embodiment, one or more surfaces of one portion of the data line DA and one portion of the connecting line CL are already curvedly formed, and the wire WI is used to connect one portion of the data line DA having the curved surface to one portion of the connecting line CL having the curved surface. As a result, the wire WI is used to efficiently connect the data line DA to the connecting line CL. Thus, the repair method of the OLED display in which repair work is efficiently performed by the wire WI is provided.

While the present invention has been particularly shown and described with reference to the exemplary embodiments thereof, it will be understood by those of ordinary skill in the art that various changes in form and detail may be made therein without departing from the spirit and scope of the present invention as defined by the following claims.

What is claimed is:

1. An organic light emitting diode (OLED) display, comprising:

a substrate;

a plurality of OLEDs disposed on the substrate and separated from each other;

a plurality of pixel circuits, wherein each pixel circuit comprises a plurality of thin film transistors and each pixel circuit is connected to one of the plurality of OLEDs;

a plurality of data lines extending in a first direction on the substrate and separated from each other in a second direction crossing the first direction, wherein the plurality of data lines is connected to the plurality of pixel circuits;

a plurality of connecting lines neighboring the data lines and extending in the first direction, wherein the plurality of connecting lines is connected to the plurality of pixel circuits; and a wire directly connecting one portion of one of the plurality of data lines to one portion of one of the plurality of connecting lines neighboring the one data line, wherein one or more surfaces of the one portion of the one data line and the one portion of the one connecting line that contact the wire are curved.

2. The OLED display of claim 1, wherein the wire comprises:

a first subwire directly connecting a first portion of the one data line to a fourth portion of the one connecting line; and a second subwire separated from the first subwire and directly connecting a second portion of the one data line to a fifth portion of the one connecting line.

3. The OLED display of claim 2, wherein one of the plurality of pixel circuits connected to the one data line is faulty, and the one pixel circuit is cut off from the corresponding OLED.

4. The OLED display of claim 3, further comprising:

a third portion disposed between the first and second portions of the one data line, wherein the third portion is cut off and isolated from the first and second portions and is connected to the one pixel circuit, wherein the fourth portion, the fifth portion, and a sixth portion disposed between the fourth and fifth portions of the one connecting line are cut off and isolated from another portions of the one connecting line, wherein the first portion of the one data line is connected to the second portion of the one data line via the first subwire, the fourth, sixth, and fifth portions of the one connecting line, and the second subwire.

5. The OLED display of claim 1, wherein the plurality of connecting lines is disposed on a same layer as the plurality of data lines.

6. The OLED display of claim 1, wherein the wire is disposed on the one connecting line and on the one data line.

7. The OLED display of claim 1, wherein a surface of another portion of the one data line comprises a corner.

8. The OLED display of claim 1, wherein a surface of another portion of the one connecting line comprises a corner.

9. An organic light emitting diode (OLED) display, comprising:

a substrate;

a plurality of OLEDs disposed on the substrate and separated from each other;

a plurality of pixel circuits, wherein each pixel circuit comprises a plurality of thin film transistors connected to one of the plurality of OLEDs;

a plurality of data lines extending in a first direction on the substrate and separated from each other in a second direction crossing the first direction, wherein the plurality of data lines is connected to the plurality of pixel circuits;

a plurality of connecting lines neighboring the data lines and extending in the first direction, wherein the plurality of connecting lines is connected to the plurality of pixel circuits; and a wire directly connecting one portion of one of the plurality of data lines to one portion of one of the plurality of connecting lines neighboring the one data line, wherein surfaces of one portions of the plurality of data lines corresponding to the one portion of the one data line and surfaces of one portions of the plurality of connecting lines corresponding to the one portion of the one connecting line are curved.

10. The OLED display of claim 9, wherein the wire comprises:

a first subwire directly connecting a first portion of the one data line and a fourth portion of the one connecting line; and a second subwire separated from the first subwire and directly connecting a second portion of the one data line and a fifth portion of the one connecting line.

* * * * *